US007762442B2

(12) United States Patent
Liang et al.

(10) Patent No.: US 7,762,442 B2
(45) Date of Patent: Jul. 27, 2010

(54) CONTROL MECHANISM FOR PNEUMATIC NAIL GUNS

(75) Inventors: Chia-Sheng Liang, Taipei Hsien (TW); Yi-Hui Chen, Taipei Hsien (TW)

(73) Assignee: De Poan Pneumatic Corp., Taipei (TW)

( * ) Notice: Subject to any disclaimer, the term of this patent is extended or adjusted under 35 U.S.C. 154(b) by 154 days.

(21) Appl. No.: 12/173,025

(22) Filed: Jul. 15, 2008

(65) Prior Publication Data

US 2010/0012699 A1 Jan. 21, 2010

(51) Int. Cl.
*B25C 1/04* (2006.01)

(52) U.S. Cl. ..... 227/2; 227/8

(58) Field of Classification Search ..... 227/2, 227/5, 8

See application file for complete search history.

(56) References Cited

U.S. PATENT DOCUMENTS 3,612,379 A * 10/1971 Panock ..... 227/8
3,638,532 A * 2/1972 Novak ..... 91/220
3,685,396 A * 8/1972 Obergfell ..... 91/356
3,774,293 A * 11/1973 Golsch ..... 29/432.1
4,040,554 A * 8/1977 Haytayan ..... 227/8
4,122,904 A * 10/1978 Haytayan ..... 173/15
4,403,722 A * 9/1983 Nikolich ..... 227/8
4,483,280 A * 11/1984 Nikolich ..... 123/46 SC
4,483,474 A * 11/1984 Nikolich ..... 227/8
5,996,874 A * 12/1999 Fukushima et al. ..... 227/8
7,191,927 B2 * 3/2007 Segura ..... 227/8
2003/0222113 A1 * 12/2003 Burke et al. ..... 227/8
2007/0075113 A1 4/2007 Tillinghast et al.
2007/0261546 A1 * 11/2007 Lee ..... 91/418

FOREIGN PATENT DOCUMENTS

TW M312401 5/2007

* cited by examiner

*Primary Examiner*—Brian D Nash
(74) *Attorney, Agent, or Firm*—Chun-Ming Shih

(57) ABSTRACT

In a controlling mechanism for pneumatic nailer, the pneumatic nailer includes a leaf spring, a trigger, a trigger valve and a safety rod attached to a main body of the nailer. The control mechanism includes a control valve and a connecting rod. The control vale includes a valve plug adjacent to the safety rod. The connecting rod is engaged with the valve plug and the safety rod. The connecting rod extends to a position that is capable of being pressed by the leaf spring. The connecting rod is configured for driving the valve plug and the safety rod to move downwardly when the leaf spring press thereof, thereby controlling the pressurized air to drive the nail gun. As such, the valve plug can move in to a position that can to control the nail hitting action of the nail gun in advance so the stability of control increases.

22 Claims, 21 Drawing Sheets

CONTROL MECHANISM FOR PNEUMATIC NAIL GUNS

BACKGROUND

The present invention relates to control devices for nail hitting of pneumatic nail guns, and particularly to a control device capable of controlling nail hitting action of nail guns according to thickness of workpiece.

Currently, pneumatic nail guns are widely used to join a workpiece (for example, a gasket) onto an object with a nail. The workpiece may include a through hole preformed on it. The users must align a nail with the through hole and then press the nail into the through hole and the object to fix the workpiece. To reduce difficulty of aligning, people developed a nail gun exposing a tip of the nail outside the nail gun.

In addition, different workpieces have different thickness. To provide ability of automatically detecting workpieces that are in predetermined thickness range in pneumatic nail guns, conventionally, the pneumatic nail includes a safety rod installed in a main passageway. The main passageway usually connects a trigger valve and a main valve. The safety rod includes a positioning member formed at a bottom end. When the safety rod reaches a predetermined height above the object, a control valve conducts pressurized air to open the main valve; as a result, the pressurized air drives a drive rod to hit the nail. The predetermined height includes a thickness of the workpiece or a depth of the through hole. The user can place a tip of the nail exposed from a drive track exit in the through hole. The tip is in contact with a surface of the object. The positioning member is sustained by the workpiece, and the depth of the through hole is reflected by a relative distance between the tip and the positioning member. When a height of the positioning member is in a predetermined range, the control valve conduct pressurized air to switch the main valve to an open state, and then the pressurized air drives the drive rod to hit the nail.

US Patent Publication No. 20070075113 discloses a pneumatic nail gun having a control device for nail hitting action, which employs a swinging pole and a valve stem. A safety rod can drive the swinging pole. The swinging pole can block or release the valve stem. In other words, the safety rod can control blocking or releasing of the valve stem. As a result, the safety rod can also control the mail valve to open to start press nail. However, the valve stem is directly controlled by the pressurized air, the stability is relative low. Also, the swinging pole is located between the valve stem and the safety rod, and the structure is too complex. It is difficult to maintain stability of nail hitting action.

Further, Taiwan Patent Publication No. M312401 also discloses a pneumatic nail gun with a control device providing a safety design for hitting action. The nail gun has a hollow valve bolt driven or released by a safety rod, and a valve cover which can exhaust the pressurized air to the outer atmosphere through opening or closing the main air flow passage controlled by the valve bolt. The safety rod is first driven to move up to block the valve bolt. The high pressure air in the main air flow passage is then exhausted to the outer atmosphere by pulling the trigger. The main air valve can be controlled to hit nails. However, the passage configuration between the hollow valve bolt and the valve cover is complicated; resulting in adequate air in the main air chamber and the main air flow passage, thus the stability of the nail gun is insufficient.

BRIEF SUMMARY

To overcome above problems of insufficient stability of controlling of nail hitting and too complicated arrangement, the present invention provides a control mechanism for pneumatic nail gun, which can improve stability of controlling of nail hitting and reduce complexity of the pneumatic nail gun and flow passages.

In one embodiment, a controlling mechanism for pneumatic nailer is provided. The pneumatic nailer includes a trigger, a trigger valve and a safety rod attached to a main body of the nailer. The trigger is disposed at a side of the trigger valve. A leaf spring is disposed between the trigger valve and the trigger and is configured for receiving triggering operation of the trigger. The control mechanism includes a control valve, a connecting rod. The control vale includes a valve plug adjacent to the safety rod. The connecting rod is engaged with the valve plug and the safety rod. The connecting rod extends to a position that is capable of being pressed by the leaf spring. The connecting rod is configured for driving the valve plug and the safety rod to move downwardly when the leaf spring press thereof, thereby controlling the pressurized air to drive the pneumatic nail gun.

In the present control mechanism, the connecting rod can receive actuation from the leaf spring. As such, the valve plug can move in the control valve to a position that can control the nail hitting action of the nail gun in advance, resulting good control stability of nail hitting and simplified arrangement of nail gun.

In another embodiment, a control mechanism for a pneumatic nail gun is provided. The pneumatic nail gun includes a trigger, a trigger valve and a safety rod. The trigger is disposed at a side of the trigger valve. A leaf spring is disposed between the trigger valve and the trigger and is configured for receiving triggering operation of the trigger. The pneumatic nail gun defines a first air flow passage connecting the trigger valve to the control valve, and a second air flow passage for controlling nail hitting by conducting the pressurized air from the control valve. The control mechanism includes a control valve having a valve plug adjacent to the safety rod. The control mechanism further includes a valve sleeve telescopically disposed in the control valve and a connecting rod. The valve sleeve defines at least one first air hole, and at least one second air hole between an inner sidewall surface and an outer sidewall surface thereof The first air hole is in communication with the first air flow passage, and the second air hole is in communication with the second air flow passage. The valve plug is slidably received in the valve sleeve. An upper sealing ring is disposed on the valve plug and is above the first air hole, a middle sealing ring is disposed on the valve plug and is between the first air hole and the second air hole, the upper sealing ring and the second sealing ring are configured for separating the first air flow passage from the second air flow passage. The connecting rod is engaged with the valve plug and the safety rod. The connecting rod extends to a position that is capable of being pressed by the leaf spring. The connecting rod is configured for driving the valve plug and the safety rod to move downwardly when the leaf spring press thereof, thereby controlling the pressurized air to drive the nail gun.

In addition, the valve plug drives the upper sealing ring to a position that is above the first air hole when the safety rod doesn't reach the predetermined height such that the first air flow passage and the second air flow passage are separated.

The valve plug drives the upper sealing ring to a position that is above the first air hole and the middle sealing ring to a position that is under the second air hole such that the first air flow passage is in communication with the second air flow passage.

More specific embodiments are as follows.

The valve plug moves the upper sealing ring to a position below the first air hole, the middle sealing ring to a position below the second air hole such that the first air flow passage is separated from the second air flow passage when the safety rod exceeds the predetermined height.

The control mechanism further includes a spring disposed on a top end of the valve sleeve, the spring presses the sleeve.

The control mechanism further includes an upper sealing washer, a middle sealing washer arranged on an outer sidewall surface of the valve sleeve, the first air hole and the first air flow passage are formed between the upper sealing washer and the middle sealing washer such that the first air hole is in communication with the first air flow passage.

The control mechanism further includes a lower sealing washer arranged on an outer sidewall surface of the valve sleeve, the second air hole and the second air flow passage are formed between the middle sealing washer and the lower sealing washer such that the second air hole is in communication with the second air flow passage, the valve sleeve are capable of moving the lower sealing washer to a position above the second air flow passage such that the second air hole is separated from the second air flow passage.

A through hole can be defined in an inner sidewall surface of the valve plug, the through hole is between a top end of the valve plug and the middle sealing ring, the through hole is configured for connecting the top end of the valve plug to the outer atmosphere so as to balance pressure therebetween.

The control mechanism further includes an end groove defined in the valve groove, the end groove being below the second air hole, a lower sealing ring is received in the valve plug, the end groove is configured for connecting the through hole to the outer atmosphere, the valve plug is capable of moving the lower sealing ring out of the end groove such that the through hole is separated from the atmosphere when the safety rod exceeds the predetermined height.

The leaf spring is pivotably disposed on the nail gun; the leaf sprig includes a clamping portion for receiving actuation from the trigger, and a pressing portion for pressing the connecting rod.

The connecting rod includes a receiving end for engaging with the leaf spring.

The present control mechanism will be described in detail with reference to Figs as following:

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
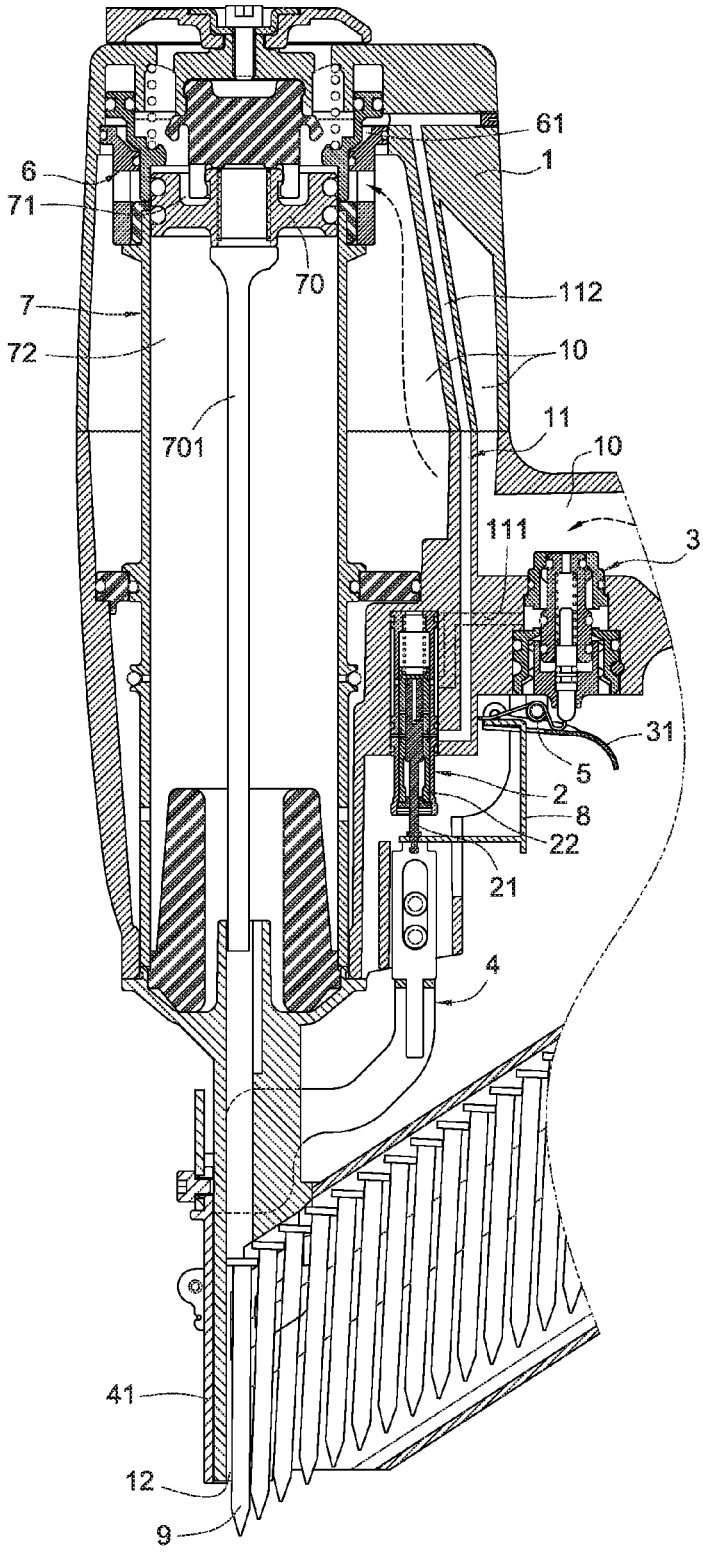
FIG. 1 is a cross-sectional view of a pneumatic nail gun according to the first embodiment of the present controlling mechanism.
Figure 2:
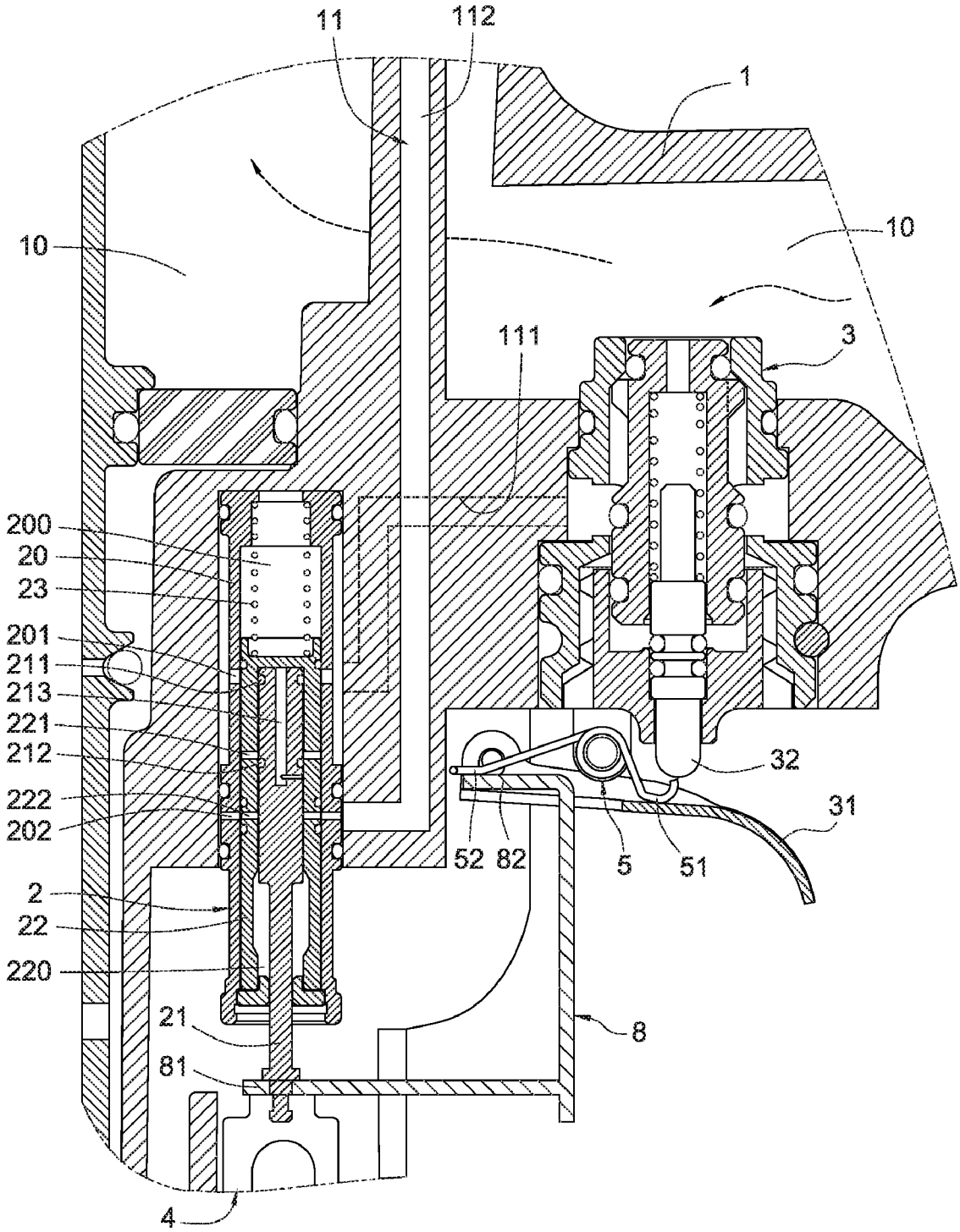
FIG. 2 is a partially enlarged view of the pneumatic nail gun of FIG. 1.
Figure 4:
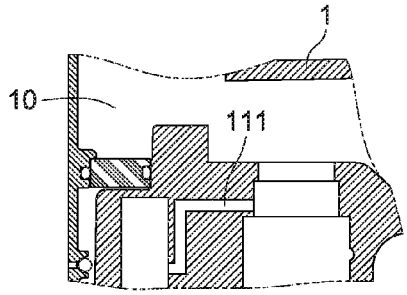
FIG. 4 is a cross-sectional view of a first air flow passage of the pneumatic nail gun according to the first embodiment.
Figure 5:
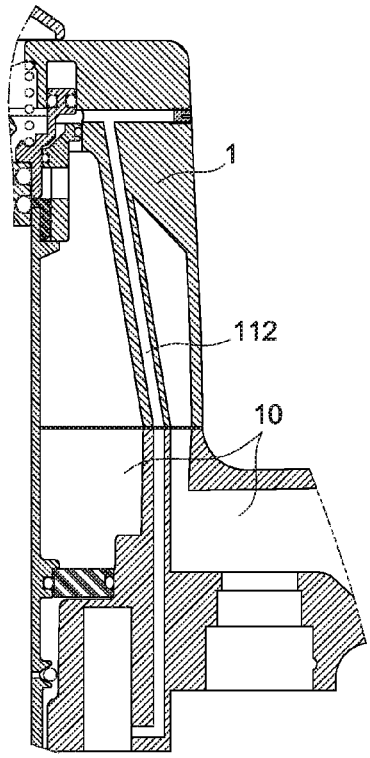
FIG. 5 is a cross-sectional view of a second air flow passage of the pneumatic nail gun according to the first embodiment.

FIG. 1 and FIG. 2 illustrate a control mechanism for nail hitting of a pneumatic nail gun according to a first embodiment. The pneumatic nail gun includes a main body 1, and a control valve 2, a trigger valve 3 and a safety rod 4 mounted on the main body 1. The trigger valve 3 includes a trigger 31 pivotably mounted at a side. A leaf spring 5 arranged between a main body of the trigger valve 3 and the trigger 31 can receive actuation of the trigger 31. The main body 1 includes a main air flow passage 11, which includes a first air flow passage 111 and a second air flow passage 112 (as shown in FIGS. 4 and 5). The first air flow passage 111 connects the trigger valve 3 to the control valve 2. The second air flow passage 112 connects the control valve 2 to a main valve 6 disposed in an upper portion of the main body 1.

Figure 7:
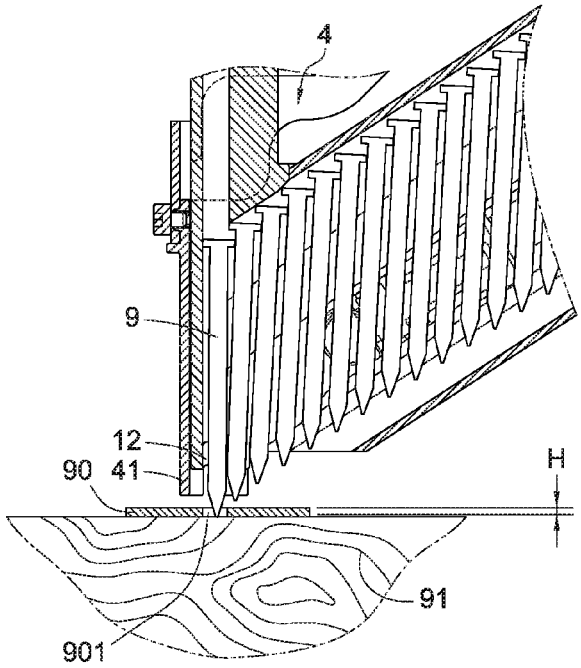
FIG. 7 is a schematic view showing a use state of a positioning member of the present controlling mechanism.
Figure 8:
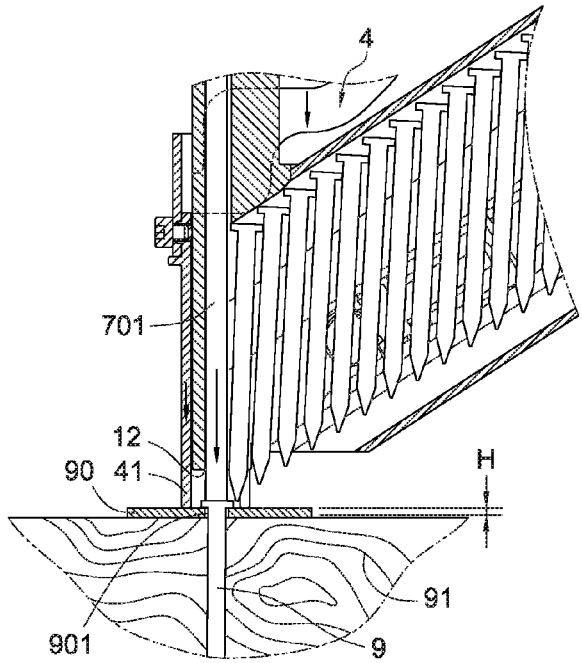
FIG. 8 is similar to FIG. 7, but showing still another state of the positioning member.
Figure 10:
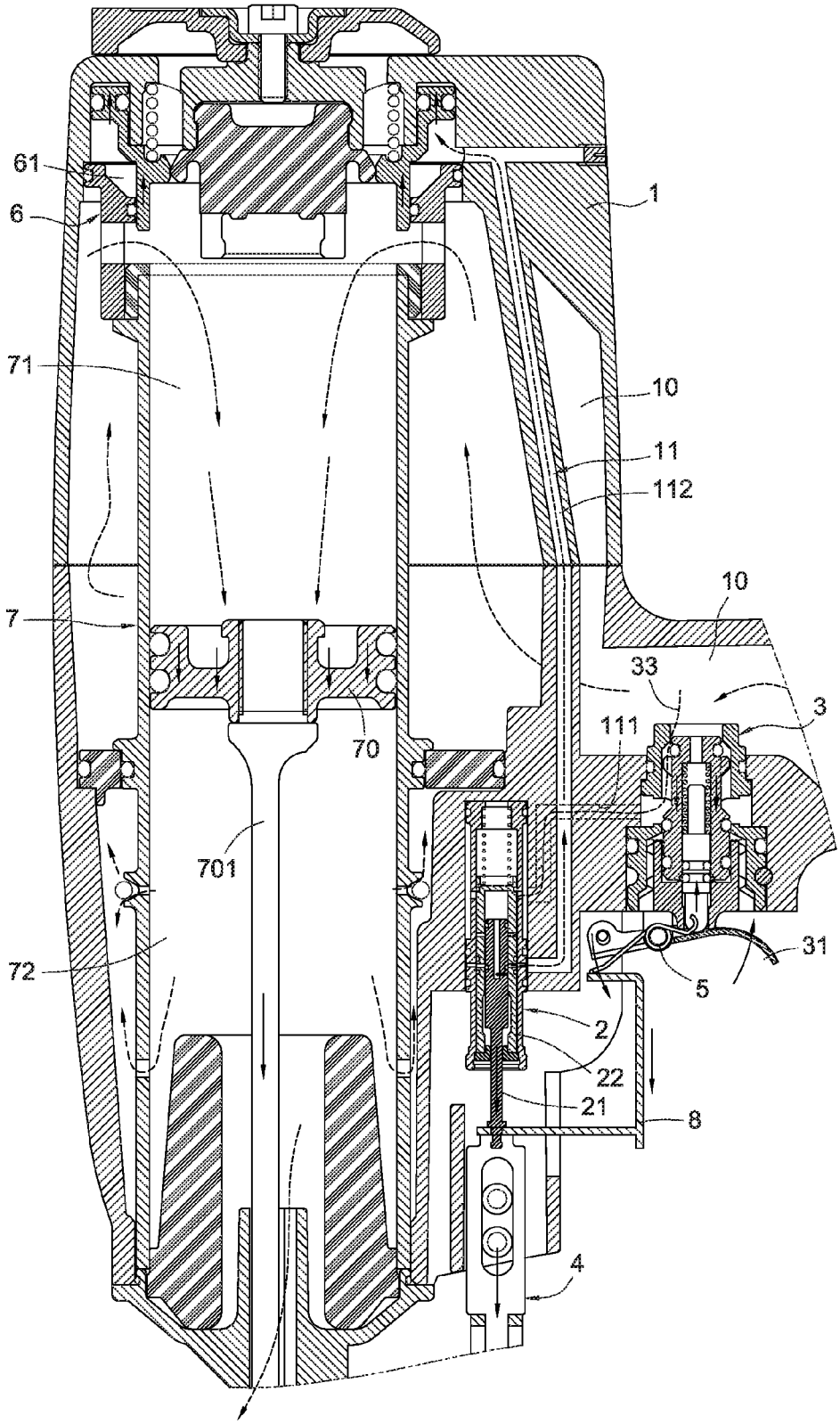
FIG. 10 is similar to FIG. 1, but showing a state of operation.
Figure 12:
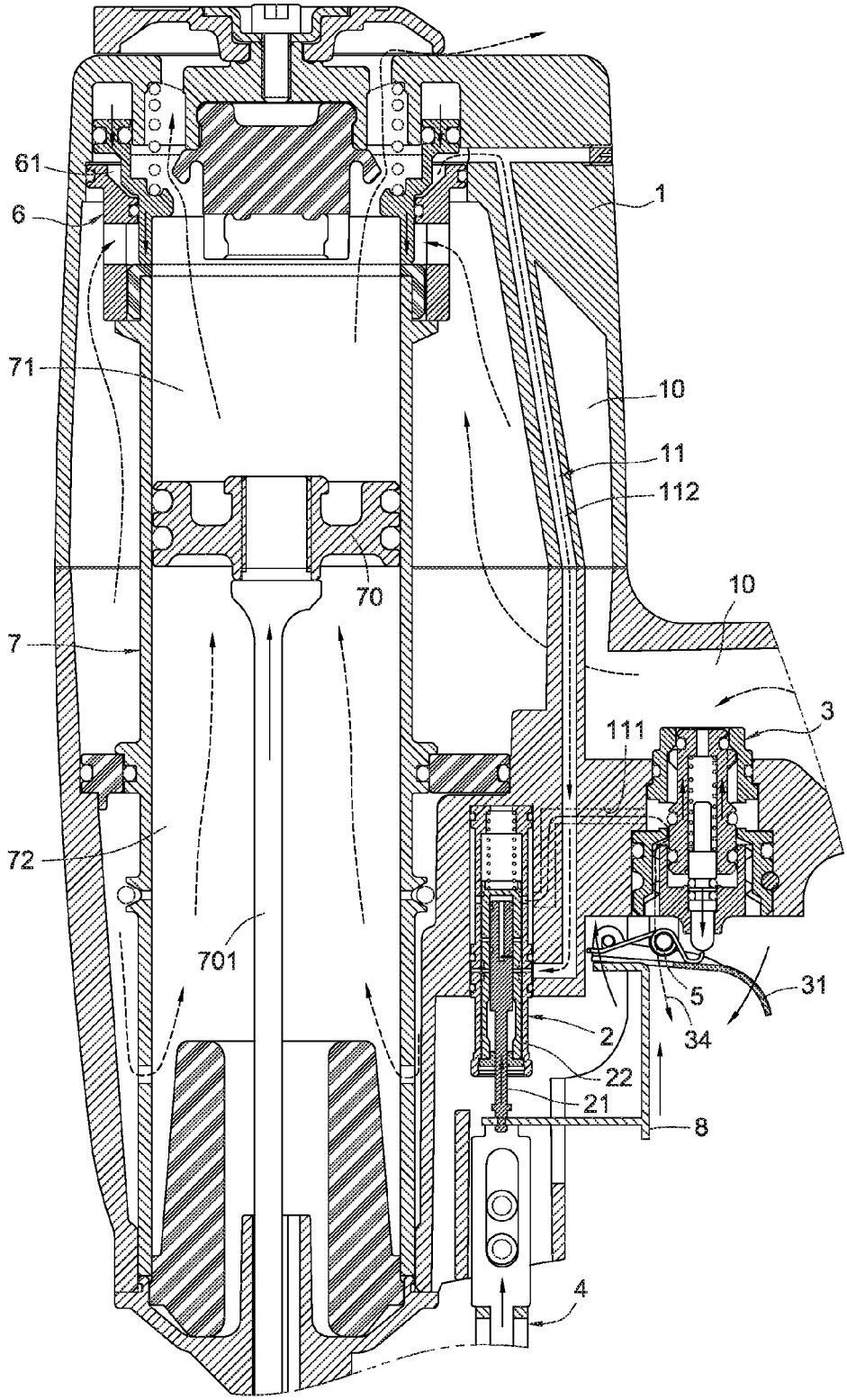
FIG. 12 is similar to FIG. 1, but showing another state of operation.

The main body 1 includes a reservoir 10 and a cylinder 7 (as shown in FIG. 1 and FIG. 2). The reservoir 10 surrounds the main valve 6 and the cylinder 7. The reservoir 10 contains pressurized air maintained at a constant pressure. The cylinder 7 is adjacent to a bottom end of the main valve 6. The main air flow passage connects the trigger valve 3, the control valve 2, and the main valve 6 in serial. The main valve 6 can receive actuation from the pressurized air in the main air flow passage 11 to control communication between the reservoir 10 and the cylinder 3 (as shown in FIGS. 10 and 12). The trigger valve 3 can conduct the pressurized air in the reservoir 10 to pass through the control valve 2 and open the main valve 6. As a result, the pressurized air drives the nail gun to hit a nail. Arranged at a bottom end of the safety rod 4 is a positioning member 41 for pressing a workpiece 90 (as shown in FIGS. 7 and 8). The positioning member 41 extends through a nail exit 12 of the main body 1. The control valve 2 includes a valve base 20 mounted on the main body 1.

Figure 11:
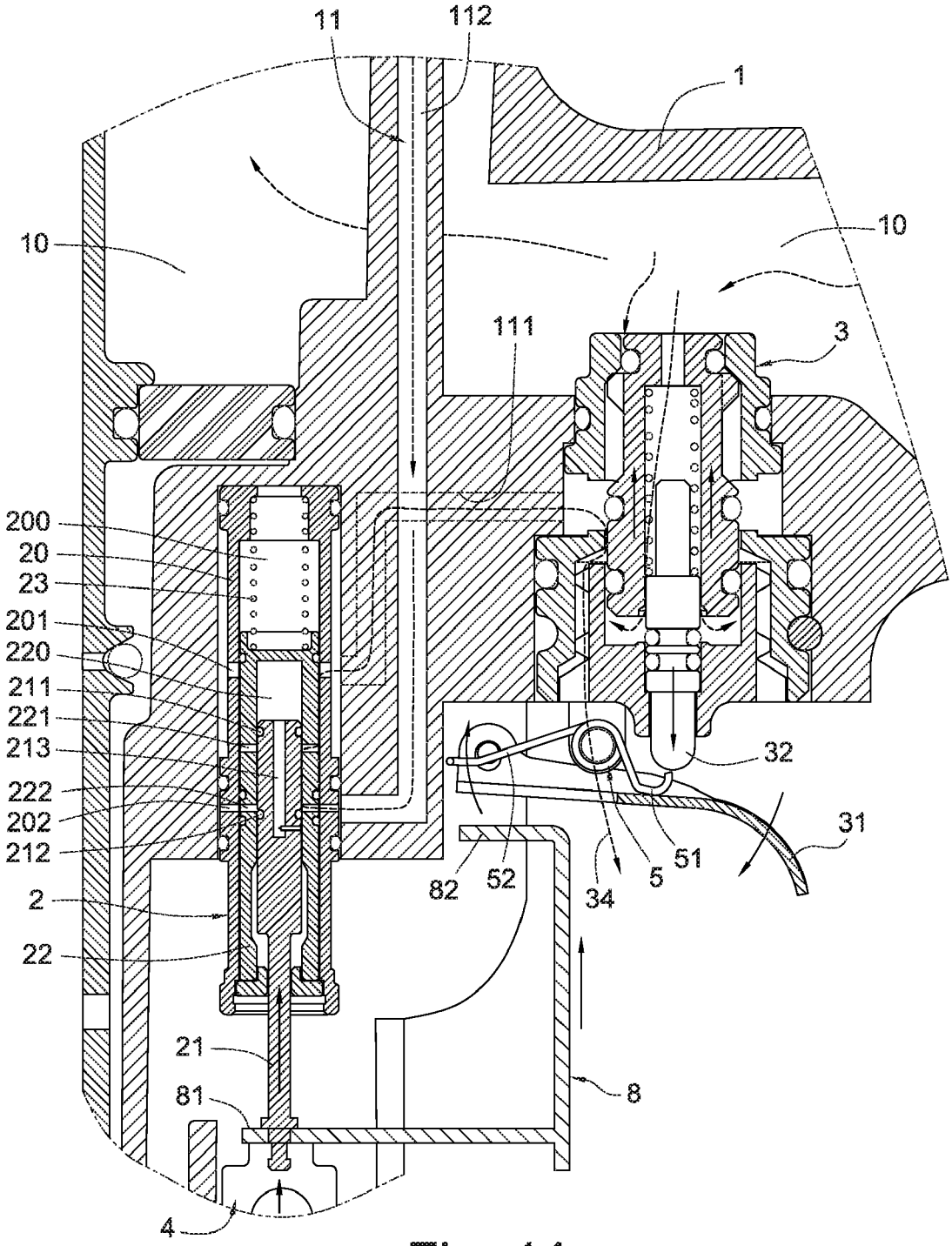
FIG. 11 is similar to FIG. 2, but showing another state of operation.

The main valve 6 includes a main chamber 61 (as shown in FIG. 1) in communication with the second air flow passage 112. The main chamber 61 can collect pressurized air from the second air flow passage 112 to drive the main valve to open top portion of the cylinder 7 (as shown in FIG. 10). When the top portion of cylinder 7 is opened, the pressurized air in the reservoir 10 enters the cylinder 7. A piston 70 with a drive rod 701 fixed on it is slidably disposed in the cylinder 7. The piston 70 divides the inner space of the cylinder 7 into an upper cylinder room 71 and a lower cylinder room 72. The trigger valve 3 includes a valve stem 32 that can be actuated or released by the trigger 31 (as shown in FIG. 2). The trigger valve 3 provides an ingress passage 33 when the valve stem 32 is at a predetermined position, and a venting passage 34 when the valve stem 32 is at another predetermined position (as shown in FIG. 11). A spring 42 is disposed between the safety rod 4 and a bottom end of the main body 1. The safety rod 4 can move up with the positioning member 41 and the valve plug 21 such that a nail 9 received in a nail drive groove of the main body is exposed outside of the nail exit 12 and the positioning member 41.

Figure 6:
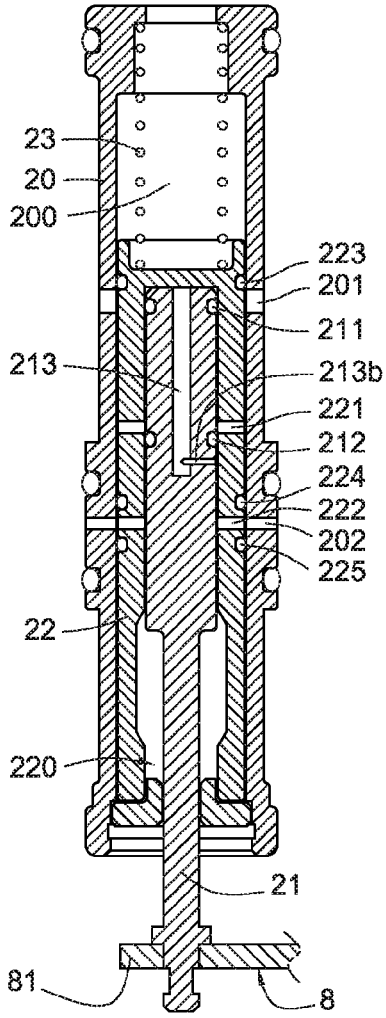
FIG. 6 is a cross-sectional view of a control valve of the pneumatic nail gun according to the first embodiment.

Referring to FIGS. 1 and 2, the control mechanism in accordance with a first embodiment includes a valve sleeve 22 and a connecting rod 8. The valve base 20 provides a slide groove 200. In addition, the valve base 20 also provides an air inlet 201 (as shown in FIG. 6) and an air outlet 202 between an inner sidewall and an outer sidewall of the valve base 20. The air inlet 201, the air outlets 202 are in communication with the first air flow passage 111, the second air flow passage 112 respectively. The air inlet 201 and the air out let 202 are also in communication with a respective slide groove 200. In the present embodiment, there are a number of air inlets 201 and a number of air outlets 202. The valve sleeve 22 is telescopically and slidably received in the slide groove 200; specifically, in the present embodiment, a spring 23 is disposed between a top end of the valve sleeve 22 and an inner sidewall of the slide groove 200. The spring 23 can drive the valve sleeve 22 to move downwardly. That is, the spring 23 press the valve sleeve 22. The valve sleeve 22 provides a guide groove 220 in it. The valve sleeve 22 also provides a number of first air holes 221 and a number of second air holes 222 arranged between an inner sidewall and an outer sidewall of the valve sleeve 22. The first air holes 221 are in communication with the first air flow passage 111 through the air inlets 201, and the second air holes 222 are in communication with the second air flow passage 112 through the air outlets 202. In addition, the first air holes 221 and the second air holes 222 are also in communication with a respective guide groove 220. The valve plug 21 is slidably received in the guide groove 220 of the valve sleeve 22 and extends outside of the valve base 20 to reach a top end of the safety rod 4. The nail gun also provides an upper sealing ring 211 and a middle sealing ring 212. The upper sealing ring 211 is attached to the valve plug 21 and is above the first air holes 221. The middle sealing ring 212 is attached to the valve plug 21 and is between the first air holes 221 and the second air holes 222. The upper sealing ring 211 and the middle sealing ring 212 can prevent the first air flow passage 111 and the second air flow passage 112 from in communication with each other. The leaf spring 5 is mounted on the main body 1 and is between the trigger valve 3 and the trigger 31. The leaf spring 5 includes a contacting portion 51 for receiving actuation from the trigger 31, and a pressing portion 52 for pressing the connecting rod 8. The connecting rod 8 is arranged between the valve plug 21 and the top end of the safety rod 4. The connecting rod 8 includes a fixing end 81 attached to the valve plug 21 and the top end of the safety rod 4, and a receiving end 82 extending to the pressing portion 52.

In more specific embodiment:

The valve sleeve 22 provides an upper sealing washer 223, a middle sealing washer 224 and a lower sealing washer 225 (as shown in FIG. 6). The first air holes 221 and the air inlets 201 are both between the upper sealing washer 223 and the middle sealing washer 224. The air inlets 201, the first air holes 221, and the first air flow passage 111 are in communication with each other.

The second air hole 222 is formed between the middle sealing washer 224 and the lower sealing washer 225 (as shown in FIG. 6). The air outlets 202 are arranged between the middle sealing washer 224 and the lower sealing washer 225. The air outlets 202, the second air holes 222, and the second air flow passage 112 are in communication with each other.

A through hole 213 is formed from the top of the valve plug 21 to extend downwardly, and includes a through portion 213b below the middle sealing ring 212 to penetrate a sidewall surface of the valve plug 21 (as shown in FIG. 6). So that, the through hole 213 can connect the top end of the valve plug 21 to the outer atmosphere to balance the pressure between the top end of the valve plug 21 and the outer atmosphere. As a result, the valve 21 can move freely under drive of the connecting rod 8.

Figure 6A:
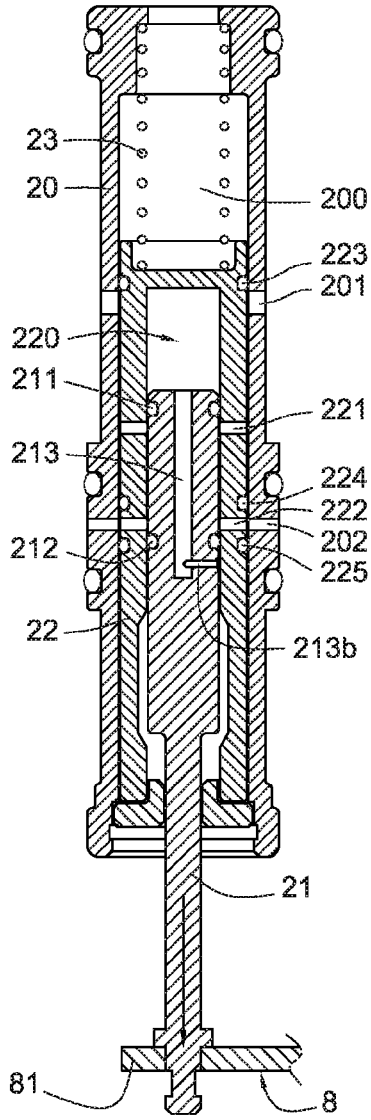
FIG. 6*a* is a schematic view showing a practical application of the control valve in FIG. 6.
Figure 7A:
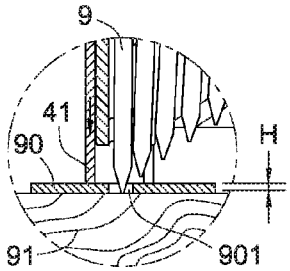
FIG. 7*a* is similar to FIG. 7, but showing another state of the positioning member.
Figure 9:
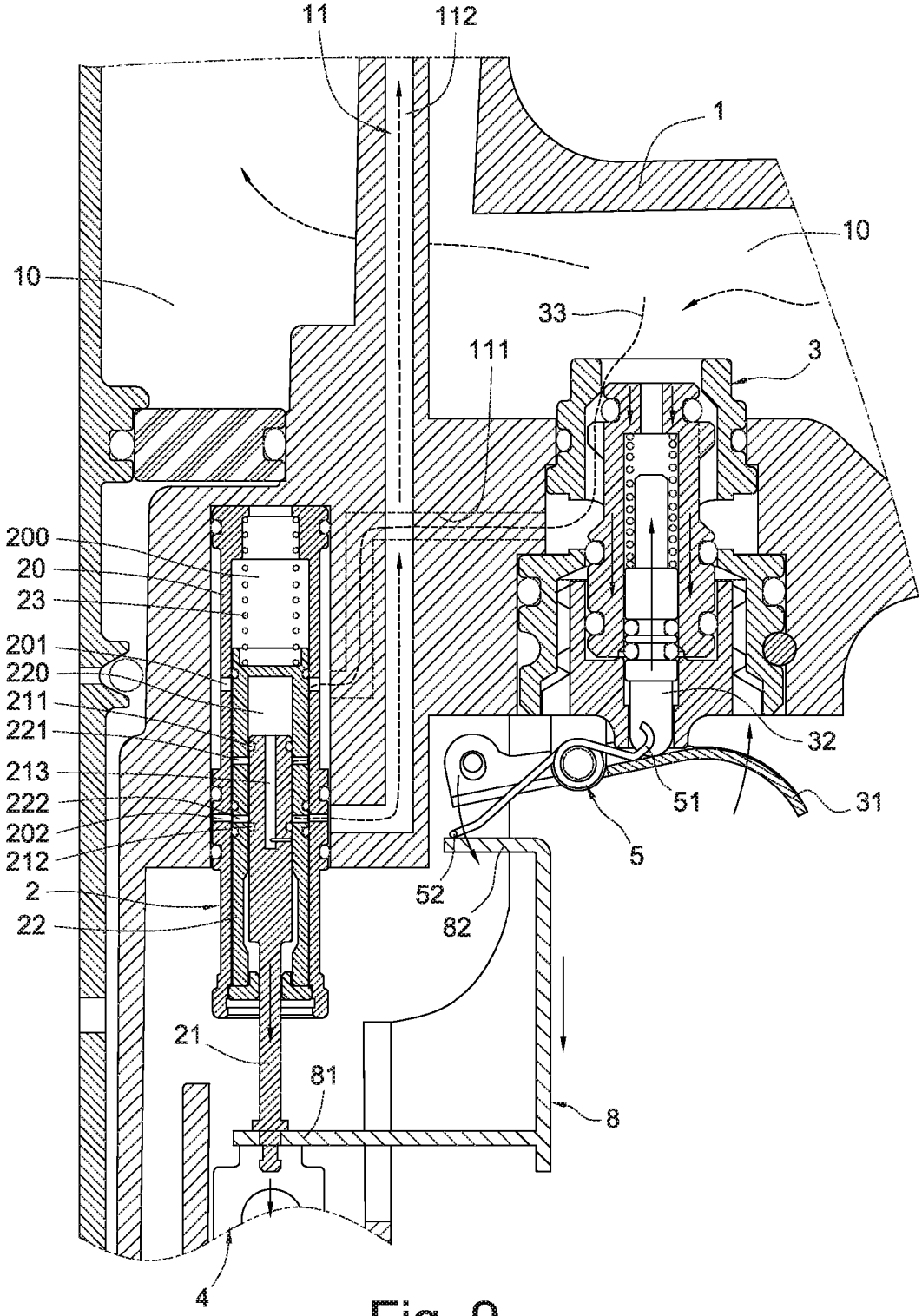
FIG. 9 is similar to FIG. 2, but showing a state of operation.

The operation state of the present pneumatic nail gun will be described in detail with reference to FIGS. 9 to 15 as flowing:

When a user try to join a workpiece 90 onto an object 91 using the pneumatic nail gun, firstly, the user can insert a tip of a nail 9 exposed from the nail exit 12 and the positioning member 41 into a through hole 901 preformed in the workpiece 90 (as shown in FIG. 7). The tip of the nail 9 can in contact with the object 91. As a same time, the positioning member 41 is above the workpiece 90. When the trigger 31 is triggered by the user (as shown in FIG. 9) the trigger 31 press the clamping portion 51 of the leaf spring 5, and the leaf spring 5 swings its pressing portion 52 to press the receiving end 82 of the connecting rod 8, the connecting rod 8 drive the valve plug 21 and the safety rod 4 to move downwardly. When the positioning member 41 of the safety rod 4 reaches a predetermined height H above the object 91 the workpiece 90 blocks the positioning member 41 (as shown in FIG. 7*a*). The predetermined height H presents a thickness of the workpiece 90 or depth of the through hole 901. The relative positions of the first air holes 221, the second air holes 22, the upper sealing ring 211, and the middle sealing ring 212 are designed for the predetermined height H. As such, the distance between the tip of the nail 9 and the bottom surface of the positioning member 41 reflects the depth of the through hole 901. When the depth of the through hole 901 is in a predetermined range, the valve plug 21 moves the upper sealing ring 211 above the first air holes 221 (as shown in FIG. 6*a*) and moves the middle sealing ring 212 below the second air holes 222. As a result, the valve plug 21 connects the air inlets 201, the first air holes 221, the second air holes 222, and the air outlets 202 to each other. The first air flow passage 111 is in communication with the second air flow passage 112. Sequentially, the trigger 31 triggers the valve stem 32 to open the trigger valve 3, the pressurized air in the reservoir 10 passes through the ingress passage 33, the first air flow passage 111, the air inlets 201, the first air holes 221, the second air holes 222, the air outlets 202 and finally enters the second air flow passage 112 and the main chamber 61 of the main valve 6 (as shown in FIG. 6). The pressurized air in the main chamber 61 drives the main valve to open the top end of the cylinder 7 and the pressurized air from the reservoir 10 enters the upper cylinder room 71 to drive the piston 70 and the drive rod 701 to move downwardly. The drive rod 701 hit the nail 9 and the nail 9 is pressed to pass through the through hole 901 and into the object 91 (as shown in FIG. 8). The nail 9 joins the workpieces 90, the object 91 together. As such, the safety rod 4 and the positioning member 41 can reflect thickness of the workpiece 90 or the depth of the through hole 901, the valve plug 21 of the control valve 2 can sense the height of the safety rod 4 and selectively conduct the pressurized air to drive the drive rod according to the height of the safety rod 4.

Figure 3:
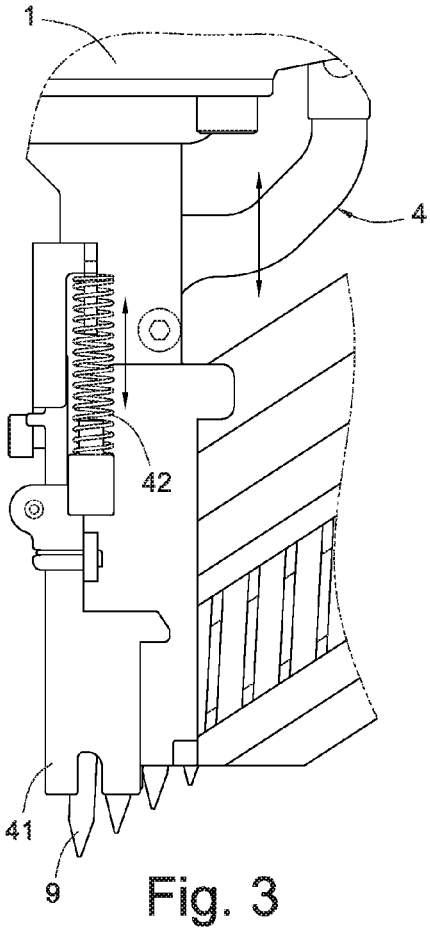
FIG. 3 is a constructional view of a safety rod of the pneumatic nail gun according to the first embodiment.

When the trigger 31 is released by the user (as shown in FIG. 11), the pressurized air in the reservoir 10 will drive the trigger valve 3 to close itself, the ingress passage 33 is closed and the vent passage 34 is open. The pressurized air in the reservoir 10 can't enter the main chamber 61 through the trigger valve 3, the main air flow passage 11, and the control valve 2. In addition, the pressurized air in the main chamber 61, the main air flow passage 11 and the control valve vents out of the nail gun from the vent passage 34 (as shown in FIG. 12). The pressurized air in the reservoir 10 drives the main valve 6 to close the top end of the cylinder 7, the piston 70 return to its original position. Simultaneously, the trigger also leave the clamping portion 51 of the leaf spring 5, the pressing portion 52 of the leaf spring 5 releases the receiving end 82 of the connecting rod 8. The spring 42 (as shown in FIG. 3) disposed at the bottom end of the main body 1 drive the safety rod 4, the positioning member 41, the connecting rod 8 and the valve plug 21 return to their original positions. The first air flow passage 111 and the second air flow passage 112 are isolated from each other (as shown in FIG. 2).

Figure 13:
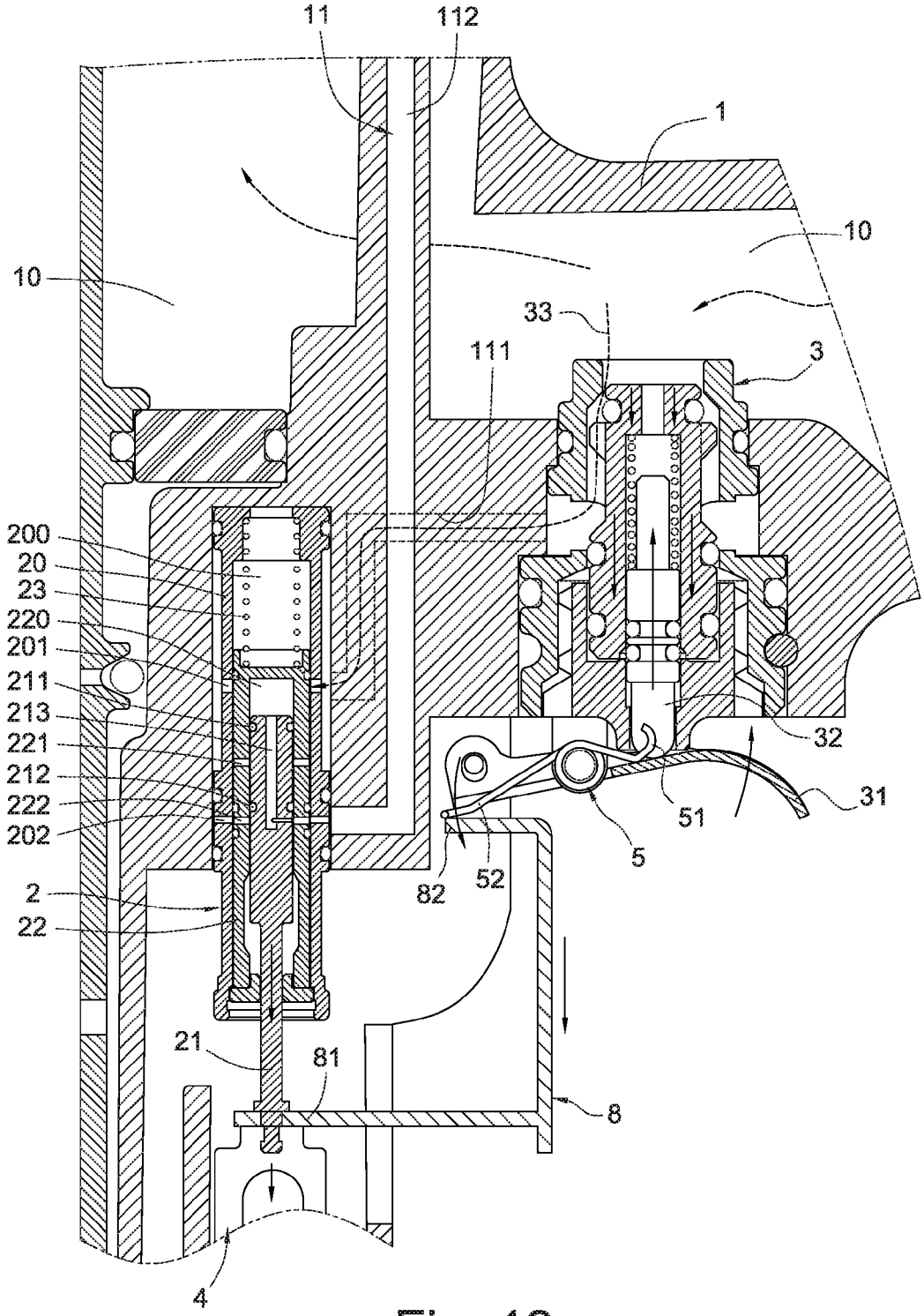
FIG. 13 is similar to FIG. 2, but showing a third state of operation.

In addition, if the thickness of the workpiece 90 or the depth of the through hole 901 is larger than the predetermined height H, the displacement of the safety rod 4 reduces. In this instance, referring to FIG. 13, when the user actuate the trigger 31, the trigger will firstly press the leaf spring 5 to push the connecting rod 8 downwardly (as shown in FIG. 13). The connecting rod 8 moves down the valve plug 21 and the safety rod 4. The distance between the positioning member 41 of the safety rod 4 and the object 91 doesn't reach a predetermined range of the height H. As such, the valve plug 21 moves the upper sealing ring 211 to a position above the first air holes 221, and the middle sealing ring 212 to a position between the first air holes 221 and the second air holes 222. The first sealing ring 211 and the second sealing ring 221 separate the first air flow passage 111 from the second air flow passage 112. Sequentially, the trigger 31 also opens the trigger valve 3, the pressurized air in the reservoir 10 also passes through the main air flow passage 33, the first air flow passage 111, and then enters the air inlets 201 of the control valve 2. However, the control valve 2 separates the first air flow passage 111 and the second air flow passage 112, the pressurized air can't enters the upper cylinder room 71 to drive the drive rod. In other words, the nail gun is braked down.

Figure 14:
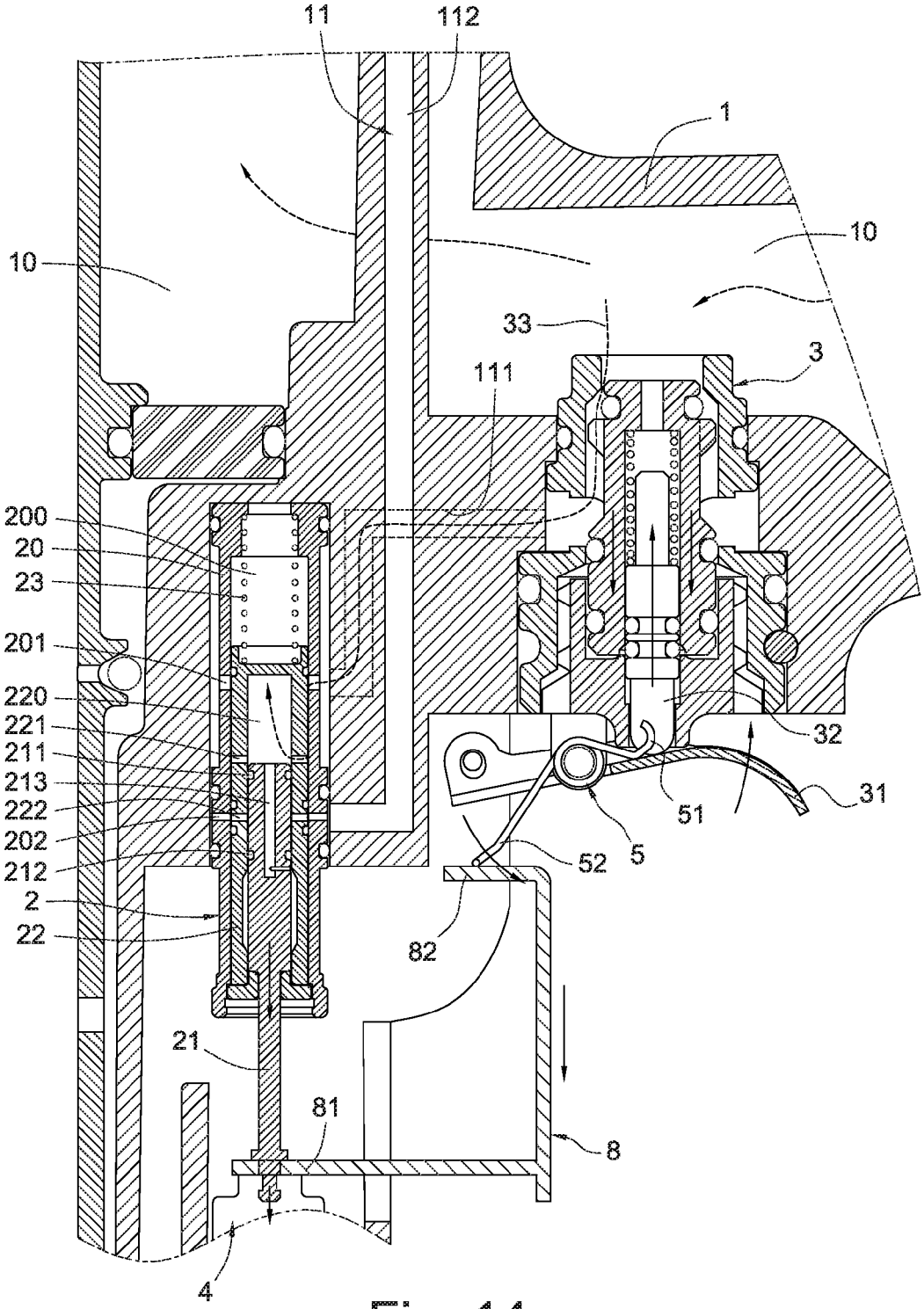
FIG. 14 is similar to FIG. 2, but showing a fourth state of operation.
Figure 15:
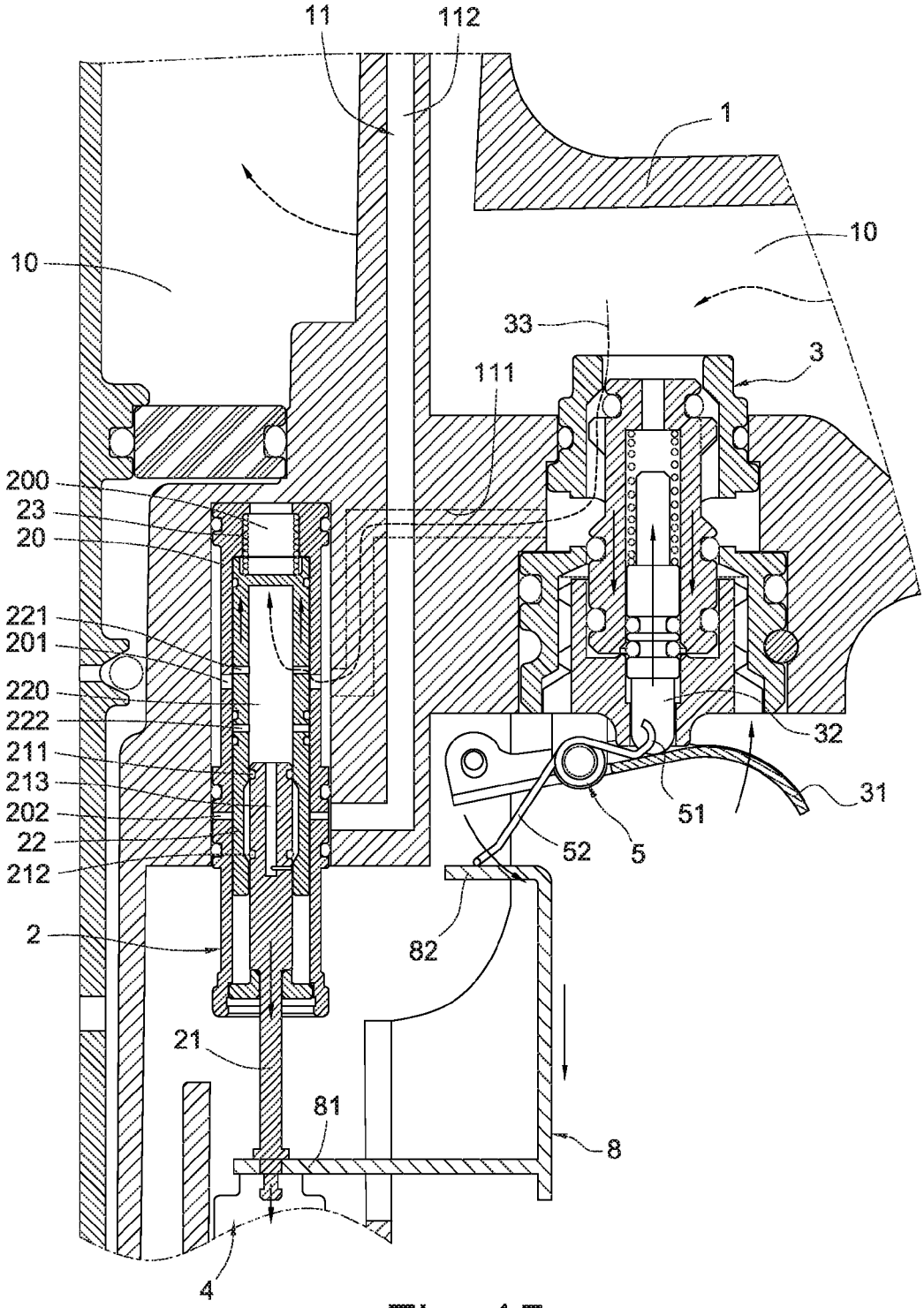
FIG. 15 is similar to FIG. 14, but showing a fifth state of operation.

In addition, if the thickness of the workpiece 90 or the depth of the through hole 901 is less than the predetermined height H, the displacement of the safety rod 4 increases. In this instance, when the user actuate the trigger 31, the trigger will firstly press the leaf spring 5 to push the connecting rod 8 downwardly (as shown in FIG. 14). The connecting rod 8 moves down the valve plug 21 and the safety rod 4. The distance between the positioning member 41 of the safety rod 4 and the object 91 exceeds the predetermined range of the height H. As such, the valve 21 moves the upper sealing ring 211 to a position below the first air holes 221, and the middle sealing ring 212 to a position below the second air holes 222. The first sealing ring 211 and the second sealing ring 221 separate the first air flow passage 111 from the second air flow passage 112. Sequentially, the trigger 31 also opens the trigger valve 3, the pressurized air in the reservoir 10 also passes through the main air flow passage 33, the first air flow passage 111, and then enters the air inlets 201 of the control valve 2, and further enters the guide groove 220 through the first air holes 221. The pressurized air drive the valve sleeve 22 move upwardly (as shown in FIG. 15) such that the upper sealing ring 211 and the middle sealing ring 212 are below the second air holes 222. The valve sleeve 22 also moves the lower sealing washer 225 to a position above the air outlets 202. The lower sealing washer 225 separates the second air holes 222 and the second air flow passage 112. The nail gun is also braked. If the user try to directly press the nail 9 into the object 91, the positioning member 41 of the safety rod 4 will exceed the position of the predetermined height H; in the other case, if the user trigger the trigger 31 by a mistake, the positioning member 41 of the safety rod 4 will also exceed the position of the predetermined height H. In these instances, the pressurized air will drive the valve sleeve 22 to move upwardly. As a result, the upper sealing ring 211 and the middle sealing ring 212 are below the second air holes 222, and the lower sealing washer 225 is above the air outlets 202. The nail gun is braked.

As mentioned above, the connecting rod 8 of the present control mechanism can receive actuation from the leaf spring 5. As such, the valve plug 21 can move the control valve with the connecting rod 8 and the safety rod 4 to a position that can control the nail hitting action of the nail gun in advance, so the stability of control increases. In addition, the control valve 2, especially the valve sleeve 22, is driven by the pressurized air from reservoir 10, that will increase the stability of control also. Meanwhile, the arrangement of the valve sleeve 22, the valve plug 21 and the air flow passages can also reduce complexity of the nail and result in good stability.

Figure 16:
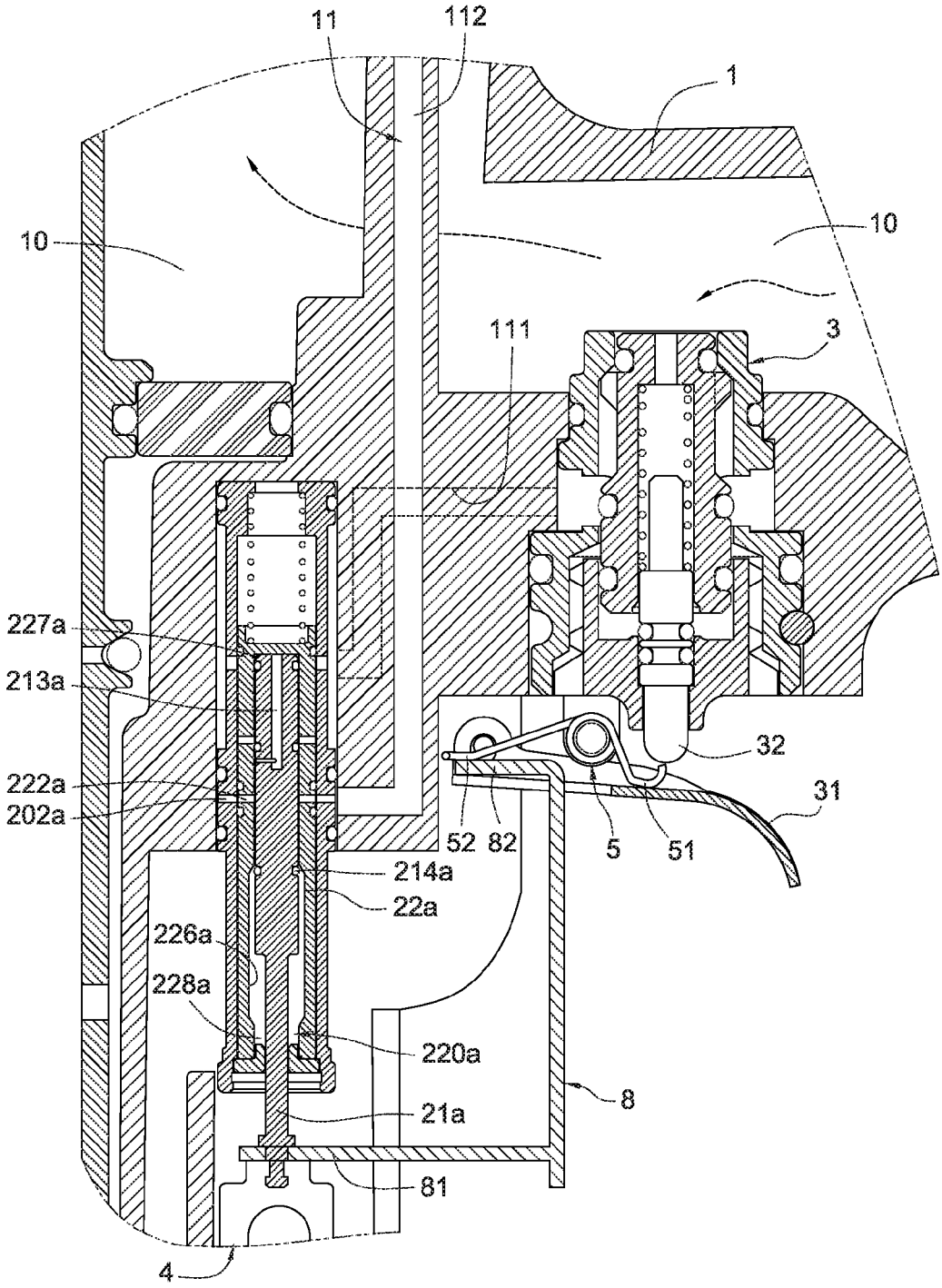
FIG. 16 is a cross-sectional view of a pneumatic nail gun according to a second preferred embodiment of the controlling mechanism.

Referring to FIG. 16, a control mechanism in accordance with a second embodiment is illustrated, in which the valve sleeve **22*a* provides an end groove 226*a* in an inner sidewall surface of a guide groove 220*a*. The end groove 226*a* is below the second air holes 222*a*. The end groove 226*a* divides the guide groove 220*a* into a top guide groove 227*a* and a lower guide groove 228*a*. In addition, a lower sealing ring 214*a* is disposed on the valve plug 21*a* and received in the end groove 226*a*. The through hole 213*a*** is in communication with the outer atmosphere. The other configuration is similar to that of the first embodiment.

Figure 17:
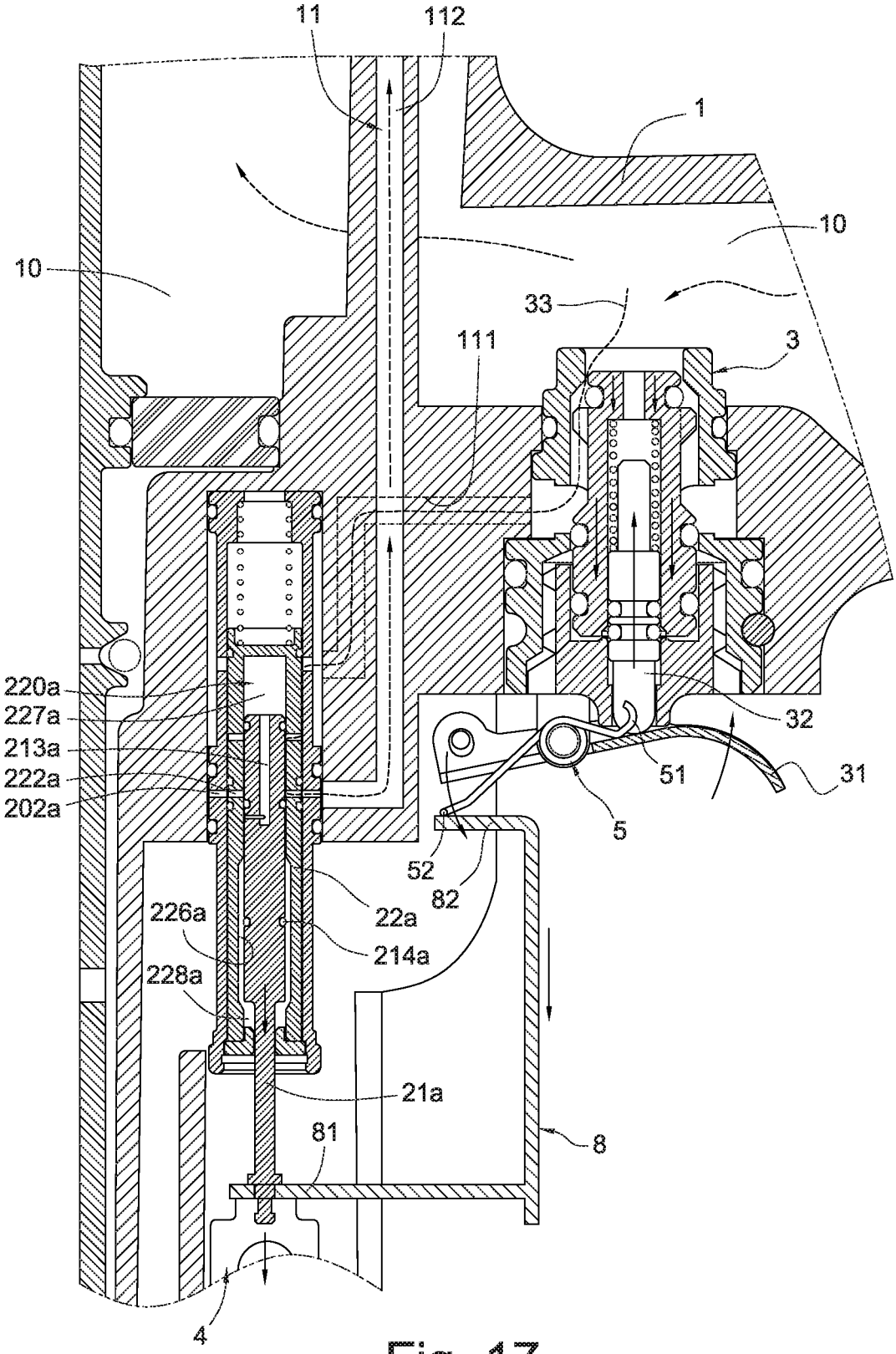
FIG. 17 is similar to FIG. 16, but showing a state of operation.
Figure 18:
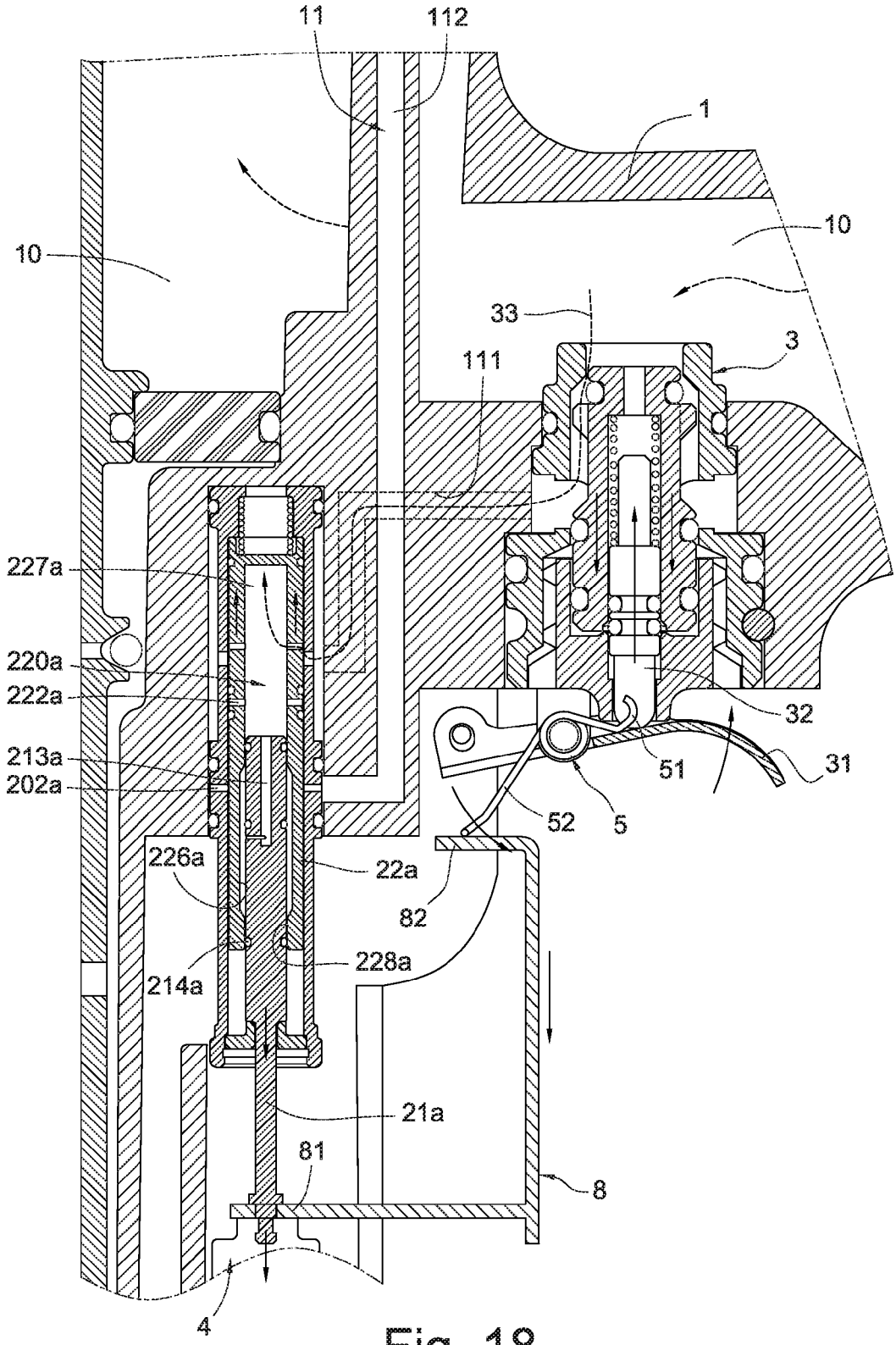
FIG. 18 is similar to FIG. 16, but showing another state of operation.

In the present embodiment, the through hole 213 connects the top guide groove **227*a* of the valve plug 21*a* to the outer atmosphere. As such, the valve plug 21*a* can move freely together with the connecting rod 8 (as shown in FIG. 16). When the positioning member of the safety rod 4 reaches to the predetermined range (as shown in FIG. 17), the valve 21*a* moves the lower sealing ring 214*a* downwardly, but lower sealing ring 214*a* is still in the end groove 226*a*, the through hole 213*a* is in communication with the outer atmosphere, the valve 21*a* can move freely together with the connecting rod 8. When the positioning member of the safety rod 4 exceeds the predetermined range of the height H, (as shown in FIG. 18), the valve plug 21*a* moves the lower sealing ring 214*a* out of the end groove 226*a*. The lower sealing ring 214*a* enters the lower guide groove 228***a* and separate the through hole 213*a* from the outer atmosphere. The pressurized air in the top guide groove 227*a* can't vents from the through hole 213*a*. The other operation of the present control mechanism is similar to that of the first embodiment.

Figure 19:
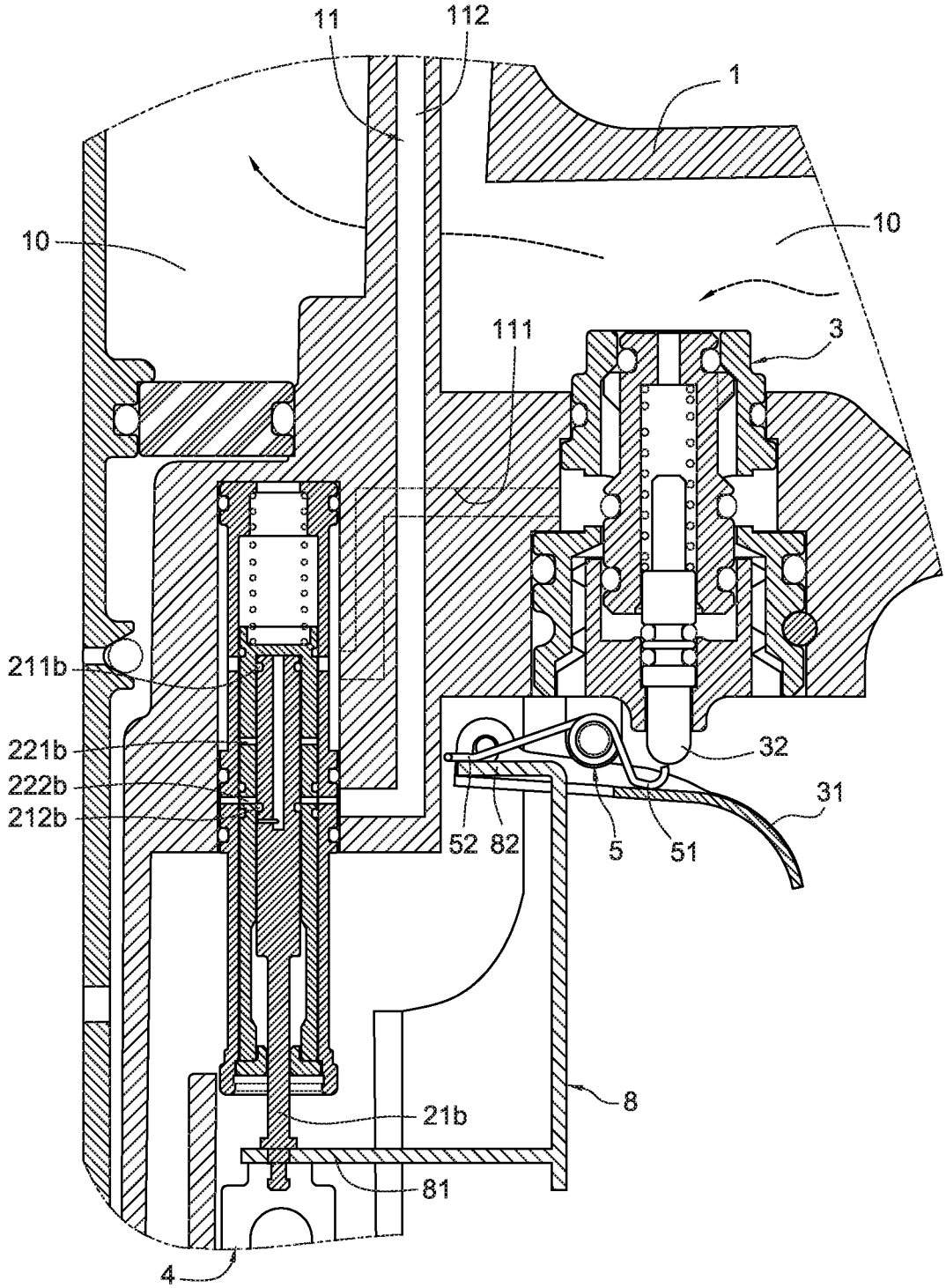
FIG. 19 is a cross sectional view showing a control mechanism in accordance with a third embodiment.

Referring to FIG. 19, a control mechanism for a pneumatic nail gun in accordance with the third embodiment is similar to that of the first embodiment except that the middle sealing ring 212*b* is arranged on the valve plug 21*b* and is under the second air hole 222*b* such that the first and second air flow passages 111, 112 are in communication with each other.

Figure 20:
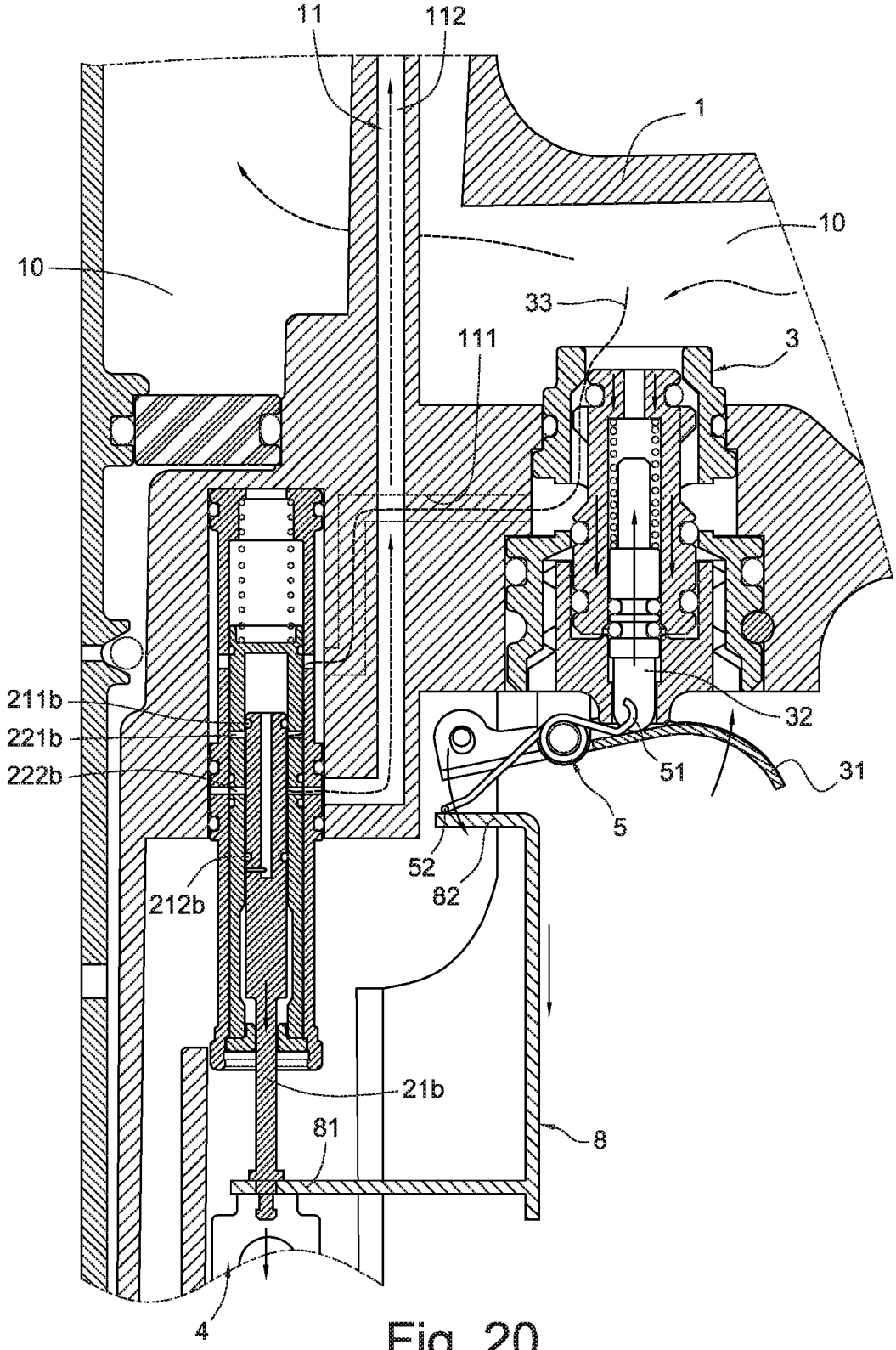
FIG. 20 is similar to FIG. 16, but showing a state of operation.
Figure 21:
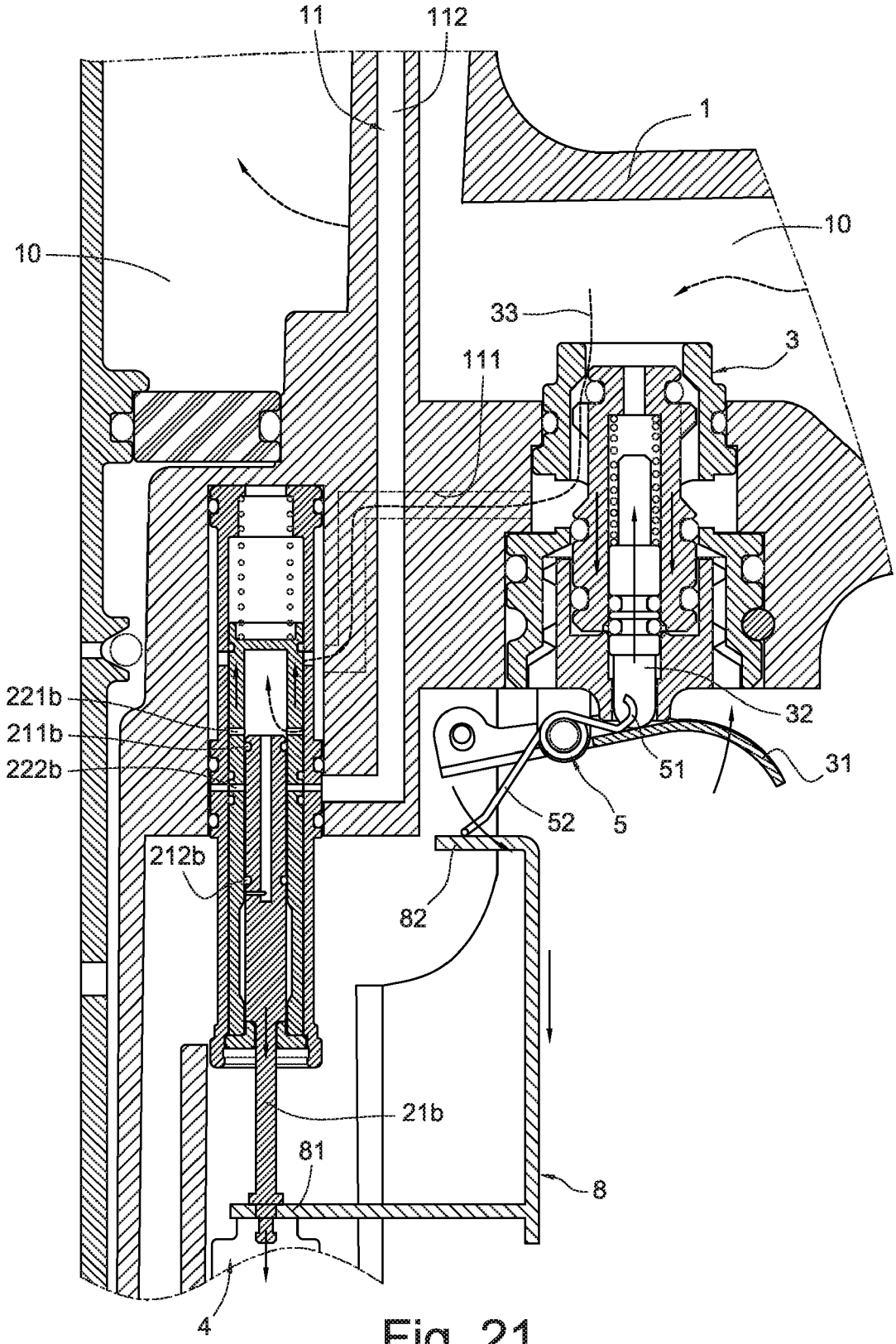
FIG. 21 is similar to FIG. 16, but showing another state of operation.

As such, when the trigger 31 is not triggered, the first and second air flow passages 111, 112 are in communication with each other (as shown in FIG. 19); therefore, if the trigger 31 drives the bottom end of the positioning member of the safety rod 4 to a position that is or not reach up the predetermined height (as shown in FIG. 20), the valve plug 21*b* both can drives the upper sealing ring 211*b* and the middle sealing ring 212*b* to move downwardly. However, the upper sealing ring 211*b* is still above the first air hole 221*b* and the middle sealing ring 212*b* is still under the second air hole 222*b*; therefore, the first and the second air flow passages 111, 112 are in communication with each other. In sequence, the trigger 31 will contact the trigger valve 3 to open it such that the pressurized air in the reservoir 10 flows through the ingress passage 33, the first air flow passage 111 and the second air flow passage 112 and drives the nail gun to hit the nail 9. When the trigger 31 drives the bottom end of the positioning member of the safety rod 4 to a position exceeding the predetermined height (as shown in FIG. 21), the valve plug 21*b* drives the upper sealing ring 211*b* to move to a position that is under the first air hole 221*b*. In addition, the valve plug 21*b* also moves the middle sealing ring 212*b* to a position that is under the second air hole 222*b* such that the first and second air flow passages 111, 112 are separated with each other. As a result, the nail gun is braked down. It is to be understood that other operation of the control mechanism is similar to that of the first embodiment.

Figure 22:
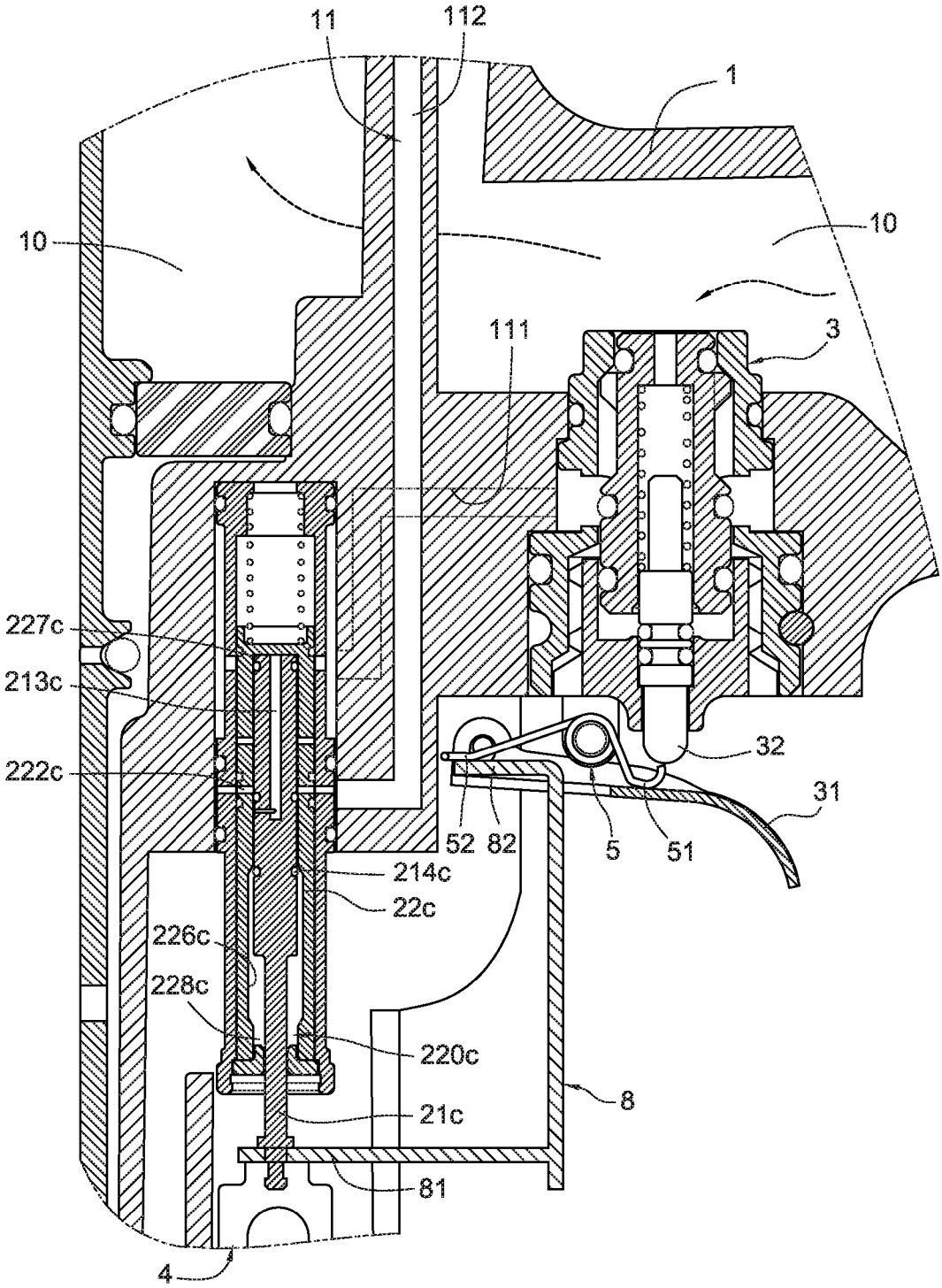
FIG. 22 is a cross sectional view showing a control mechanism in accordance with a fourth embodiment.

Referring to FIG. 22, a control mechanism for a nail gun in accordance with the fourth embodiment is similar to that of the third embodiment except that there is an expanding end groove 226*c* formed in the inner side surface of the guide groove 220*c* of the valve sleeve 22*c* and the end groove 226*c* is under the second air hole 222*c*. The end groove 226*c* divides the guide groove 220*c* to a top guide groove 227*c* and a bottom guide groove 228*c*. In addition, there is a lower sealing ring 214*c* arranged on the valve plug 21*c* and received in the end groove 226*c*. As a result, the through hole 213*c* is in communication with the atmosphere.

Figure 23:
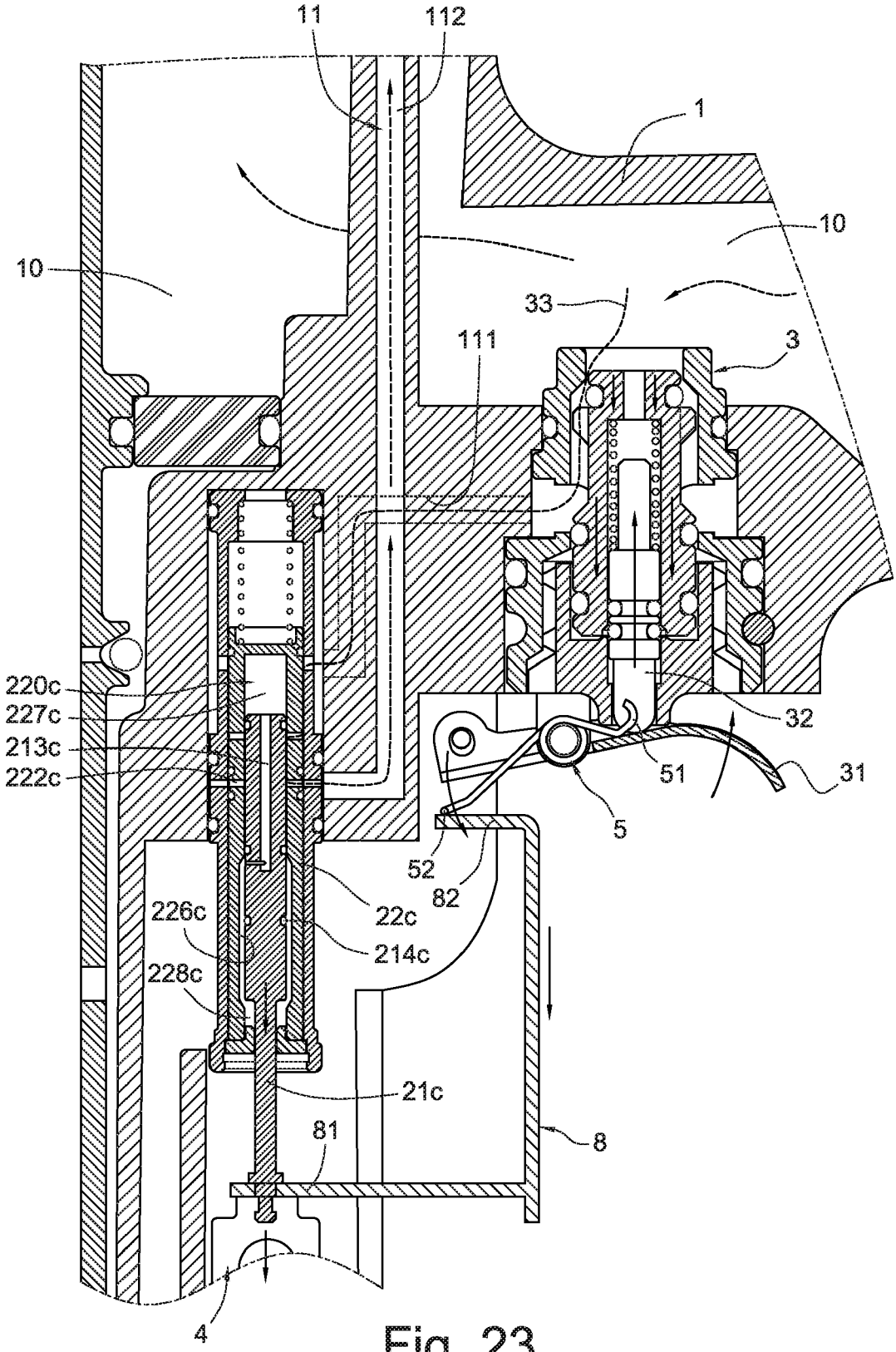
FIG. 23 is similar to FIG. 22, but showing a state of operation.
Figure 24:
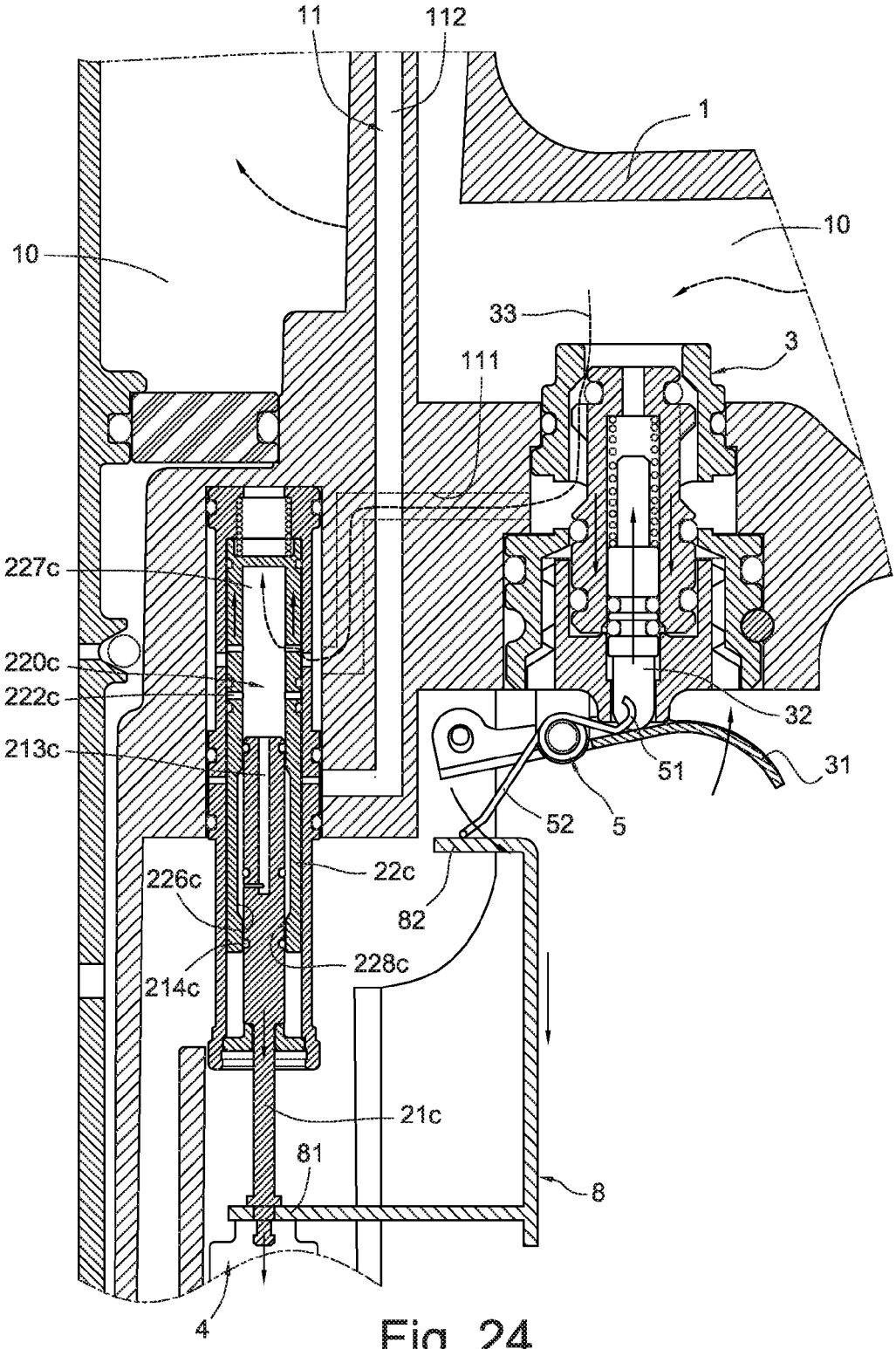
FIG. 24 is similar to FIG. 22, but showing another state of operation.

In the present embodiment, when the safety rod 4 and the valve plug 21*c* works, air in the top guide groove 227*c* can flow through the through hole 213*c* and enters into atmosphere such that the valve plug 21*c* is capable of being moved by the connecting rod 8 (as shown in FIG. 22). When the bottom end of the positioning member reaches to a position that is the predetermined range (as shown in FIG. 23), the valve plug 21*c* moves the lower sealing ring 214*c* downwardly. However, the lower sealing ring 213 is still in the end grove 226*c*. Therefore, the through hole 213*c* is in communication with the outer atmosphere such that the valve plug 21*c* is capable of being driven by the connecting rod 8 to move back and forth. When the bottom end of the positioning member reaches to a position that exceeds the predetermined range (as shown in FIG. 24), the valve plug 21*c* moves the lower sealing ring 214*c* out of the end groove 226*c*. The lower sealing ring 214*c* enters the lower guide groove 228*c* to separated the through hole 213*c* from the outer atmosphere. As a result, the air in the top guide groove 227*a* can't leaks into atmosphere through the through hole 213*a*.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A control mechanism for a pneumatic nail gun, the pneumatic nail gun comprising a trigger, a trigger valve and a safety rod, the trigger being disposed at a side of the trigger valve, the pneumatic nail gun defining a first air flow passage connecting the trigger valve to the control valve, and a second air flow passage for controlling nail hitting by conducting pressurized air-from the control valve, the control mechanism comprising a control valve comprising a valve plug adjacent to the safety rod;

wherein the control mechanism further comprising:

a valve sleeve telescopically disposed in the control valve, the valve sleeve defining at least one first air hole, and at least one second air hole between an inner sidewall surface and an outer sidewall surface thereof, the first air hole being in communication with the first air flow passage, the second air hole being in communication with the second air flow passage;

the valve plug being slidably received in the valve sleeve, an upper sealing ring being disposed on the valve plug and is above the first air hole, a middle sealing ring being disposed on the valve plug and is between the first air hole and the second air hole, the upper sealing ring and the second sealing ring are configured for separating the first air flow passage from the second air flow passage; and a connecting rod engaging with the valve plug and the safety rod, the connecting rod being configured for driving the valve plug and the safety rod to move downwardly to a predetermined height in advance, thereby controlling the pressurized air to drive the pneumatic nail gun.

2. The control mechanism as claimed in claim 1, wherein the valve plug moves the upper sealing ring to a position above the first air hole, the middle sealing ring to a position between the first air hole and the second air hole such that the first air flow passage is separated from the second air flow passage when the safety rod doesn't reach the predetermined height.

3. The control mechanism as claimed in claim 1, wherein the valve plug moves the upper sealing ring to a position below the first air hole, the middle sealing ring to a position below the second air hole such that the first air flow passage is separated from the second air flow passage when the safety rod exceeds the predetermined height.

4. The control mechanism as claimed in claim 1, further comprising a spring disposed on a top end of the valve sleeve, the spring pressing the sleeve.

5. The control mechanism as claimed in claim 1, further comprising an upper sealing washer, a middle sealing washer arranged on an outer sidewall surface of the valve sleeve, the first air hole and the first air flow passage being formed between the upper sealing washer and the middle sealing washer such that the first air hole is in communication with the first air flow passage.

6. The control mechanism as claimed in claim 1, further comprising a middle sealing washer, a lower sealing washer arranged on an outer sidewall surface of the valve sleeve, the second air hole and the second air flow passage being formed between the middle sealing washer and the lower sealing washer such that the second air hole is in communication with the second air flow passage, the valve sleeve being capable of moving the lower sealing washer to a position above the second air flow passage such that the second air hole is separated from the second air flow passage.

7. The control mechanism as claimed in claim 1, wherein a through hole is formed from top of the valve plug to extend downwardly, and includes a through portion below the middle sealing ring to penetrate a sidewall surface of the valve plug, the through hole being configured for connecting a top end of the valve plug to the outer atmosphere so as to balance pressure therebetween.

8. The control mechanism as claimed in claim 7, further comprising an end groove defined in the valve groove, the end groove being below the second air hole, a lower sealing ring is received in the valve plug, the end groove being configured for connecting the through hole to the outer atmosphere, the valve plug being capable of moving the lower sealing ring out of the end groove such that the through hole is separated from the atmosphere when the safety rod exceeds the predetermined height.

9. The control mechanism as claimed in claim 1, wherein a leaf spring is disposed between the trigger valve and the trigger, the connecting rod extending to a position that is capable of being pressed by the leaf spring such that the connecting rod can be driven to move downwardly when the trigger is triggered.

10. The control mechanism as claimed in claim 9, wherein the leaf spring is pivotably disposed on the nail gun, the leaf sprig comprising a clamping portion for receiving actuation from the trigger, and a pressing portion for pressing the connecting rod.

11. The control mechanism as claimed in claim 9, wherein the connecting rod comprising a receiving end for engaging with the leaf spring.

12. A control mechanism for a pneumatic nail gun, the pneumatic nail gun comprising a trigger, a trigger valve and a safety rod, the trigger being disposed at a side of the trigger valve, the pneumatic nail gun defining a first air flow passage connecting the trigger valve to the control valve, and a second air flow passage for controlling nail hitting by conducting pressurized air from the control valve, the control mechanism comprising a control valve comprising a valve plug adjacent to the safety rod;

wherein the control mechanism further comprising:

a valve sleeve telescopically disposed in the control valve, the valve sleeve defining at least one first air hole, and at least one second air hole between an inner sidewall surface and an outer sidewall surface thereof, the first air hole being in communication with the first air flow passage, the second air hole being in communication with the second air flow passage;

the valve plug being slidably received in the valve sleeve, an upper sealing ring being disposed on the valve plug and is above the first air hole, a middle sealing ring being disposed on the valve plug and is between the first air hole and the second air hole, the upper sealing ring and the second sealing ring are configured for separating the first air flow passage from the second air flow passage; and a connecting rod arranged between the valve plug and the safety rod, the connecting rod extending to a position that is capable of engaging with the trigger, the connecting rod being configured for driving the valve plug and the safety rod to move downwardly to a determined height and then the upper sealing ring is above the first air hole, the middle sealing ring is under the second air hole such that the first and second air flow passages are in communication with each other, thereby controlling the pressurized air to drive the nail gun.

13. The control mechanism as claimed in claim 12, wherein the vale plug drives the upper sealing ring to a position that is above the first air hole, the middle sealing ring to a position that is under the second air hole when the safety rod moves downwardly such that the first and second air flow passage are in communication with each other.

14. The control mechanism as claimed in claim 12, wherein the valve plug moves the upper sealing ring to a position below the first air hole, the middle sealing ring to a position below the second air hole such that the first air flow passage is separated from the second air flow passage when the safety rod exceeds the predetermined height.

15. The control mechanism as claimed in claim 12, further comprising a spring disposed on a top end of the valve sleeve, the spring pressing the sleeve.

16. The control mechanism as claimed in claim 12, further comprising an upper sealing washer, a middle sealing washer arranged on an outer sidewall surface of the valve sleeve, the first air hole and the first air flow passage being formed between the upper sealing washer and the middle sealing washer such that the first air hole is in communication with the first air flow passage.

17. The control mechanism as claimed in claim 12, further comprising a middle sealing washer, a lower sealing washer arranged on an outer sidewall surface of the valve sleeve, the second air hole and the second air flow passage being formed between the middle sealing washer and the lower sealing washer such that the second air hole is in communication with the second air flow passage, the valve sleeve being capable of moving the lower sealing washer to a position above the second air flow passage such that the second air hole is separated from the second air flow passage.

18. The control mechanism as claimed in claim 12, wherein a through hole is formed from top of the valve plug to extend downwardly, and includes a through portion below the middle sealing ring to penetrate a sidewall surface of the valve plug, the through hole being configured for connecting a top end of the valve plug to the outer atmosphere so as to balance pressure therebetween.

19. The control mechanism as claimed in claim 18, further comprising an end groove defined in the valve groove, the end groove being below the second air hole, a lower sealing ring is received in the valve plug, the end groove being configured for connecting the through hole to the outer atmosphere, the valve plug being capable of moving the lower sealing ring out of the end groove such that the through hole is separated from the atmosphere when the safety rod exceeds the predetermined height.

20. The control mechanism as claimed in claim 12, wherein a leaf spring is disposed between the trigger valve and the trigger, the connecting rod extending to a position that is capable of being pressed by the leaf spring such that the connecting rod can be driven to move downwardly when the trigger is triggered.

21. The control mechanism as claimed in claim 20, wherein the leaf spring is pivotably disposed on the nail gun, the leaf sprig comprising a clamping portion for receiving actuation from the trigger, and a pressing portion for pressing the connecting rod.

22. The control mechanism as claimed in claim 20, wherein the connecting rod comprising a receiving end for engaging with the leaf spring.

* * * * *